US011161346B2

(12) United States Patent
Horade et al.

(10) Patent No.: US 11,161,346 B2
(45) Date of Patent: Nov. 2, 2021

(54) LIQUID CONSUMING DEVICE AND LIQUID CONSUMING SYSTEM

(71) Applicant: BROTHER KOGYO KABUSHIKI KAISHA, Nagoya (JP)

(72) Inventors: Kenta Horade, Toukai (JP); Masafumi Miyazawa, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/227,111

(22) Filed: Dec. 20, 2018

(65) Prior Publication Data

US 2019/0193407 A1 Jun. 27, 2019

(30) Foreign Application Priority Data

Dec. 27, 2017 (JP) ..... JP2017-252679

(51) Int. Cl.
*B41J 2/175* (2006.01)
*B41J 29/393* (2006.01)

(52) U.S. Cl.
CPC ..... *B41J 2/17509* (2013.01); *B41J 2/175* (2013.01); *B41J 2/1752* (2013.01); *B41J 2/1753* (2013.01);
(Continued)

(58) Field of Classification Search
CPC ..... B41J 2/17566
See application file for complete search history.

(56) References Cited

U.S. PATENT DOCUMENTS 6,866,355 B2 3/2005 Aruga et al.
2002/0085050 A1 7/2002 Aruga et al.
(Continued)

FOREIGN PATENT DOCUMENTS

JP 2003-15477 A 1/2003
JP 2004-181819 A 7/2004
(Continued)

OTHER PUBLICATIONS

International Search Report and Written Opinion issued in related International Patent Application No. PCT/JP2018/047484, dated Mar. 27, 2019.
(Continued)

*Primary Examiner* — Julian D Huffman
(74) *Attorney, Agent, or Firm* — Merchant & Gould P.C.

(57) ABSTRACT

A liquid consuming device includes an installation case configured to receive a cartridge having a first liquid chamber storing a liquid, a tank having a second liquid chamber, a flow path communicated with the first and second liquid chambers, a head communicated with the second liquid chamber and a first controller configured to: determine a total amount Vt of a first liquid amount in the first liquid chamber that is installed in the installation case to communicate with the second liquid chamber through the flow path and a second liquid amount in the second liquid chamber that communicates with the first liquid chamber of the cartridge installed in the installation case through the flow path; and transmit, through a first communication interface that is connected to an external device, total amount information indicating the determined total amount Vt.

23 Claims, 20 Drawing Sheets

(52) U.S. Cl.
CPC ..... *B41J 2/17513* (2013.01); *B41J 2/17523* (2013.01); *B41J 2/17546* (2013.01); *B41J 2/17553* (2013.01); *B41J 2/17566* (2013.01); *B41J 29/393* (2013.01); *B41J 2002/17573* (2013.01); *B41J 2002/17576* (2013.01)

(56) References Cited

U.S. PATENT DOCUMENTS

| | | | | |
|---|---|---|---|---|
| 2007/0252858 | A1* | 11/2007 | Kyoshima ..... | B41J 2/17546 347/7 |
| 2008/0158271 | A1 | 7/2008 | Shimizu et al. | |
| 2009/0201351 | A1 | 8/2009 | Shimizu et al. | |
| 2015/0062231 | A1* | 3/2015 | Danzuka ..... | B41J 2/17596 347/19 |
| 2017/0061268 | A1 | 3/2017 | Miyazawa | |

FOREIGN PATENT DOCUMENTS

| | | | |
|---|---|---|---|
| JP | 2008-238792 | A | 10/2008 |
| JP | 2017-47537 | A | 3/2017 |

OTHER PUBLICATIONS

Chinese Office Action for Chinese Patent Application No. 201880083739.X dated Jan. 22, 2021, 19 pages (English translation included).
Office Action issued in corresponding Japanese Patent Application No. 2017-252679, dated May 6, 2021.
Chinese Office Action issued in related application No. 201880083739.X, dated Sep. 7, 2021.

* cited by examiner

LIQUID CONSUMING DEVICE AND LIQUID CONSUMING SYSTEM

CROSS-REFERENCE TO RELATED APPLICATION

This application claims priority from Japanese Patent Application No. 2017-252679 filed on Dec. 27, 2017, the entire subject-matter of which is incorporated herein by reference.

TECHNICAL FIELD

The disclosure relates a liquid consuming device which enables a placement of an order of a cartridge in which a liquid is stored, and a liquid consuming system which includes the liquid consuming device.

BACKGROUND

There has been known a method of ordering a cartridge in which a liquid such as ink is stored. The cartridge is installed in a liquid consuming device such as a printer or a multifunction peripheral to supply a liquid to the liquid consuming device.

In the conventional ordering method, the residual-amount information which indicates the residual amount of the liquid in the cartridge is obtained to estimate a date when the liquid stored in the cartridge is used up. Next, a predetermined date on which the liquid remains in the cartridge is determined based on the estimated date. Further, a new cartridge is ordered on the determined predetermined date. Accordingly, the new cartridge is delivered to a user of the liquid consuming device until the liquid stored in the cartridge installed in the liquid consuming device is used up.

SUMMARY

Illustrative aspects of the disclosure provide a liquid consuming device including an installation case configured to receive a cartridge having a first liquid chamber storing a liquid, a tank having a second liquid chamber, a flow path communicated with the first and second liquid chambers, a head communicated with the second liquid chamber and a first controller configured to: determine a total amount Vt of a first liquid amount in the first liquid chamber that is installed in the installation case to communicate with the second liquid chamber through the flow path and a second liquid amount in the second liquid chamber that communicates with the first liquid chamber of the cartridge installed in the installation case through the flow path; and transmit, through a first communication interface that is connected to an external device, total amount information indicating the determined total amount Vt.

BRIEF DESCRIPTION OF DRAWINGS

FIGS. 2A and 2B are external views of the printer, wherein FIG. 2A illustrates a state where a cover is in a covering position, and FIG. 2B illustrates a state where the cover is in an open position;

FIGS. 5A and 5B are diagrams illustrating a structure of a cartridge, wherein FIG. 5A is a front perspective view, and FIG. 5B is a longitudinal sectional view;

DETAILED DESCRIPTION

In the conventional ordering method or the like, the residual-amount information which is a basis for determining the placement date of the order indicates the residual amount of the liquid in the cartridge installed in the liquid consuming device.

The disclosure provides a way for determining the date of ordering of a cartridge based on information including other than the residual amount of liquid in the cartridge.

An exemplary embodiment of the disclosure will be described below. It is noted that the exemplary embodiment described below is merely an example of the disclosure and can be appropriately modified without departing from the spirit of the disclosure. Further, execution orders of the following processes can be appropriately changed within the range of the scope of the disclosure.

First Exemplary Embodiment

Figure 1A:
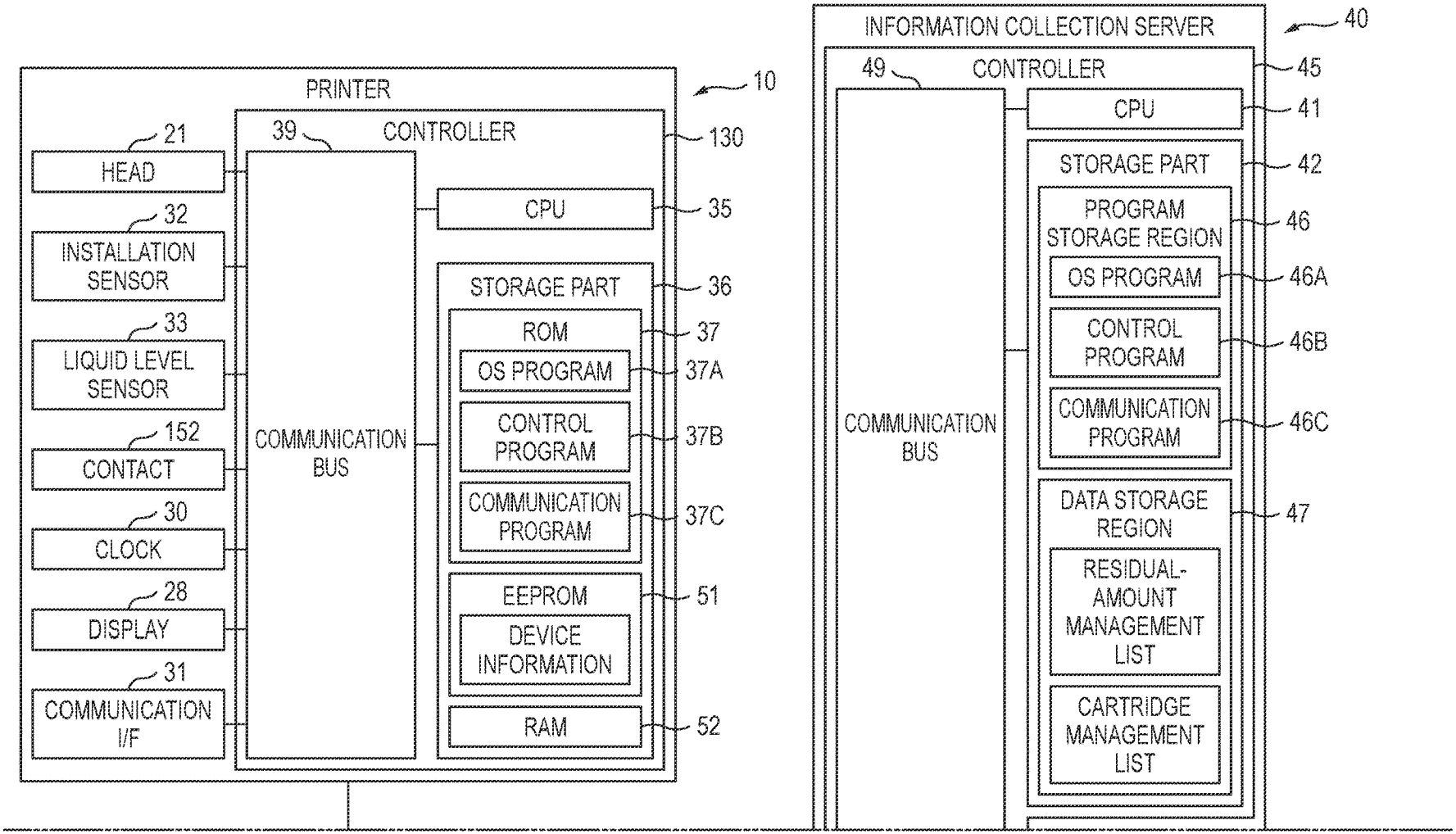
FIGS. 1A and 1B illustrate a configuration diagram of a printer and an information collection server.
Figure 1B:
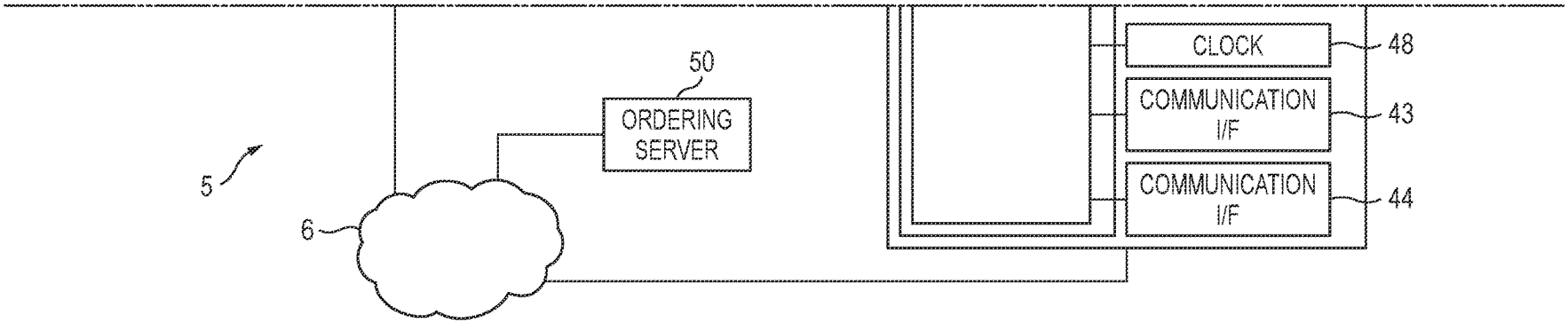

An ordering system 5 illustrated in FIGS. 1A and 1B includes a printer 10 and an information collection server 40 which collects information from one or plural printers 10. The printer 10 and the information collection server 40 are connected by a communication line 6 such as the Internet. The printer 10 and the information collection server 40 can communicate with each other by using a communication protocol such as TCP/IP. In addition, the information collection server 40 can transmit information to an ordering server 50 (FIG. 11) which accepts an order through the communication line 6. The printer 10 is one example of a liquid consuming device. The information collection server 40 is one example of the external device. The ordering system 5 is one example of a liquid consuming system.

(Outline of Printer)

Figure 2A:
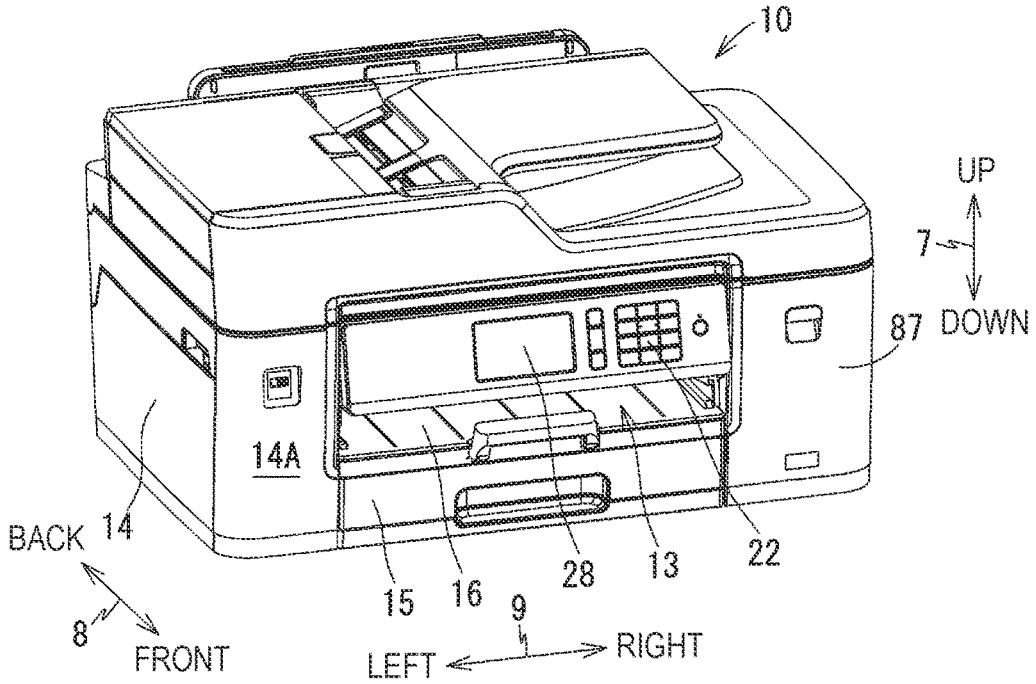
Figure 2B:
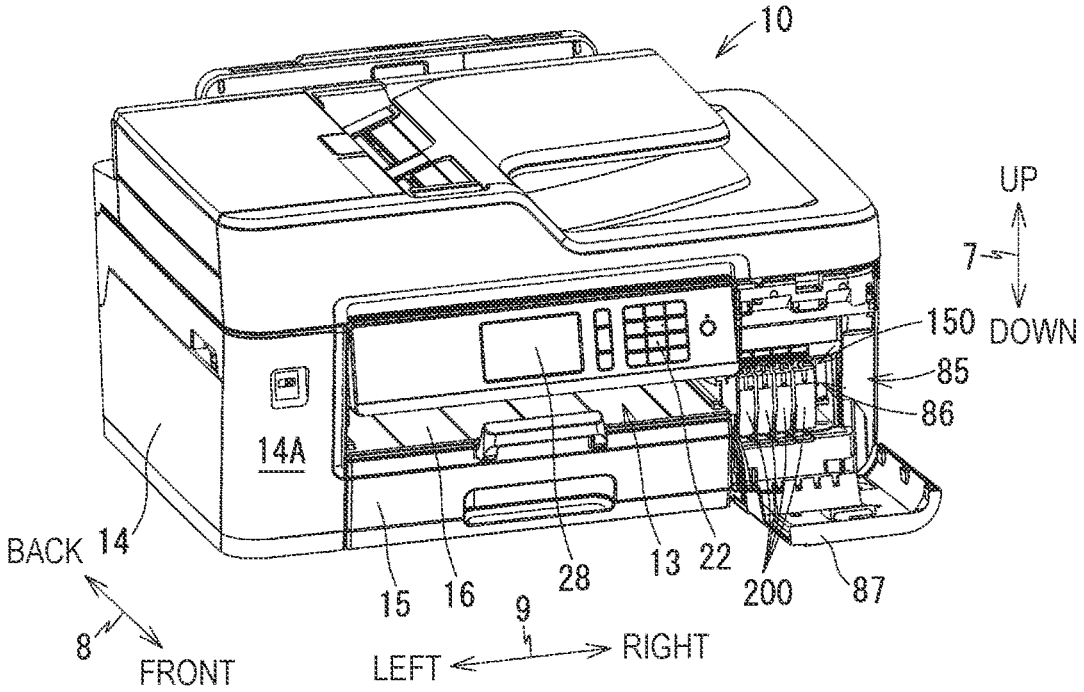

The printer 10 illustrated in FIGS. 2A and 2B is an inkjet printer which discharges ink droplets to print an image on a sheet. The printer 10 may be a multifunction peripheral having a facsimile function, a scan function, a copy function and the like.

Hereinafter, an up and down direction 7 is defined with reference to a use posture of the printer 10 installed in a horizontal plane in a usable manner, a front and back direction 8 is defined with a surface on which an opening 13 of the printer 10 is formed as a front surface, and a left and right direction 9 is defined when viewing the printer 10 from the front surface. That is, the up and down direction 7 in the use posture corresponds to a vertical direction, and the front and back direction 8 and the left and right direction 9 correspond to a horizontal direction. The front and back direction 8 and the left and right direction 9 are orthogonal to each other.

The printer 10 drives a feed roller 23 and a conveyance roller 25 to convey a sheet supported by a feed tray 15 to the position of a platen 26. Next, the printer 10 discharges ink, which is supplied from a tank 160 through a tube 19, to a head 21 through a nozzle 29. Accordingly, the ink is landed on the sheet supported by the platen 26, and an image is printed on the sheet. Then, the printer 10 drives a discharge roller 27 to discharge the sheet on which the image is printed to a discharge tray 16.

Figure 3:
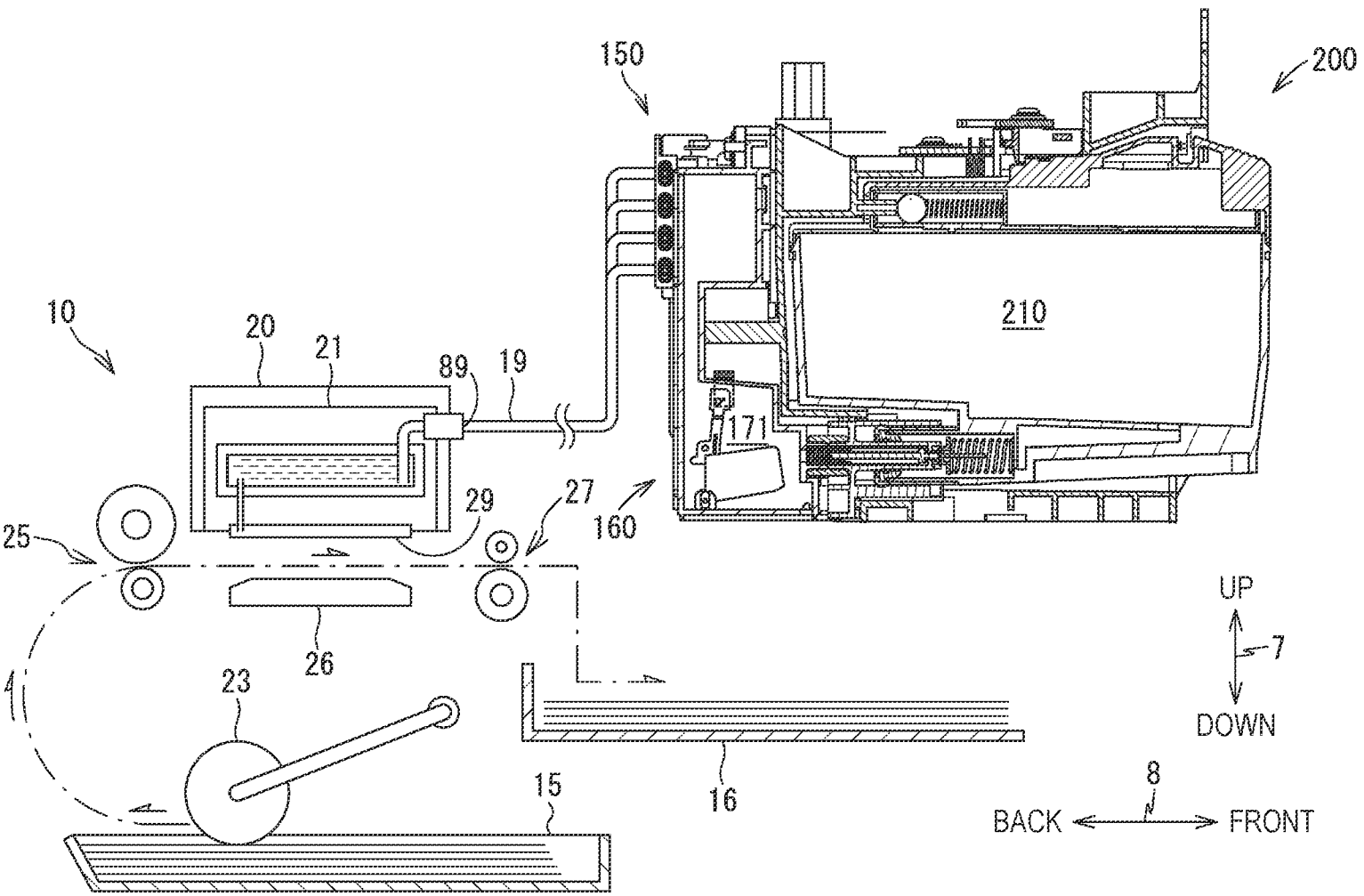
FIG. 3 is a schematic sectional view schematically illustrating an internal structure of the printer.

More specifically, the head 21 may be mounted on a carriage 20 that reciprocates along a main scanning direction (parallel to the left and right direction 9) intersecting with the sheet conveyance direction of the sheet by the conveyance roller 25. A driving force of a motor (not illustrated) is transmitted so that the carriage 20 moves along the main scanning direction (the direction perpendicular to the paper surface of FIG. 3). While the conveyance of the sheet by the conveyance roller 25 is stopped, the printer 10 discharges the ink to the head 21 through the nozzle 29 with moving the carriage 20 along the main scanning direction. Accordingly, an image is printed on a partial area of the sheet (hereinafter, referred to as "one pass") facing the head 21. Next, the printer 10 causes the conveyance roller 25 to convey the sheet so that a next image printing area of the sheet faces the head 21. Then, these processes are alternately and repeatedly executed, and thus an image is printed on one sheet.

(Display)

A housing 14 includes a display 28. The display 28 is located in the front surface of the housing 14. The display 28 is a so-called touch panel in which a touch sensor is arranged on a display panel. However, instead of the display 28 or together with the display 28, the display panel and a push button may be located in the front surface of the housing 14. The display 28 accepts an input from a user.

(Cover)

As illustrated in FIGS. 2A and 2B, an opening 85 is formed at a right end in the left and right direction 9 on a front surface 14A of the housing 14. The housing 14 further includes a cover 87. The cover 87 is rotatable between a covering position (a position illustrated in FIG. 3A) at which the opening 85 is covered and an open position (a position illustrated in FIG. 3B) at which the opening 85 is exposed. The cover 87 is supported by the housing 14 so as to be rotatable around a rotation axis along the left and right direction 9 in the vicinity of a lower end of the housing 14 in the up and down direction 7, for example. Then, an installation case 150 on which a cartridge 200 is installed is located in an accommodating space 86 which is provided inside the housing 14 and spreads backwards from the opening 85.

(Installation Case)

Figure 4:
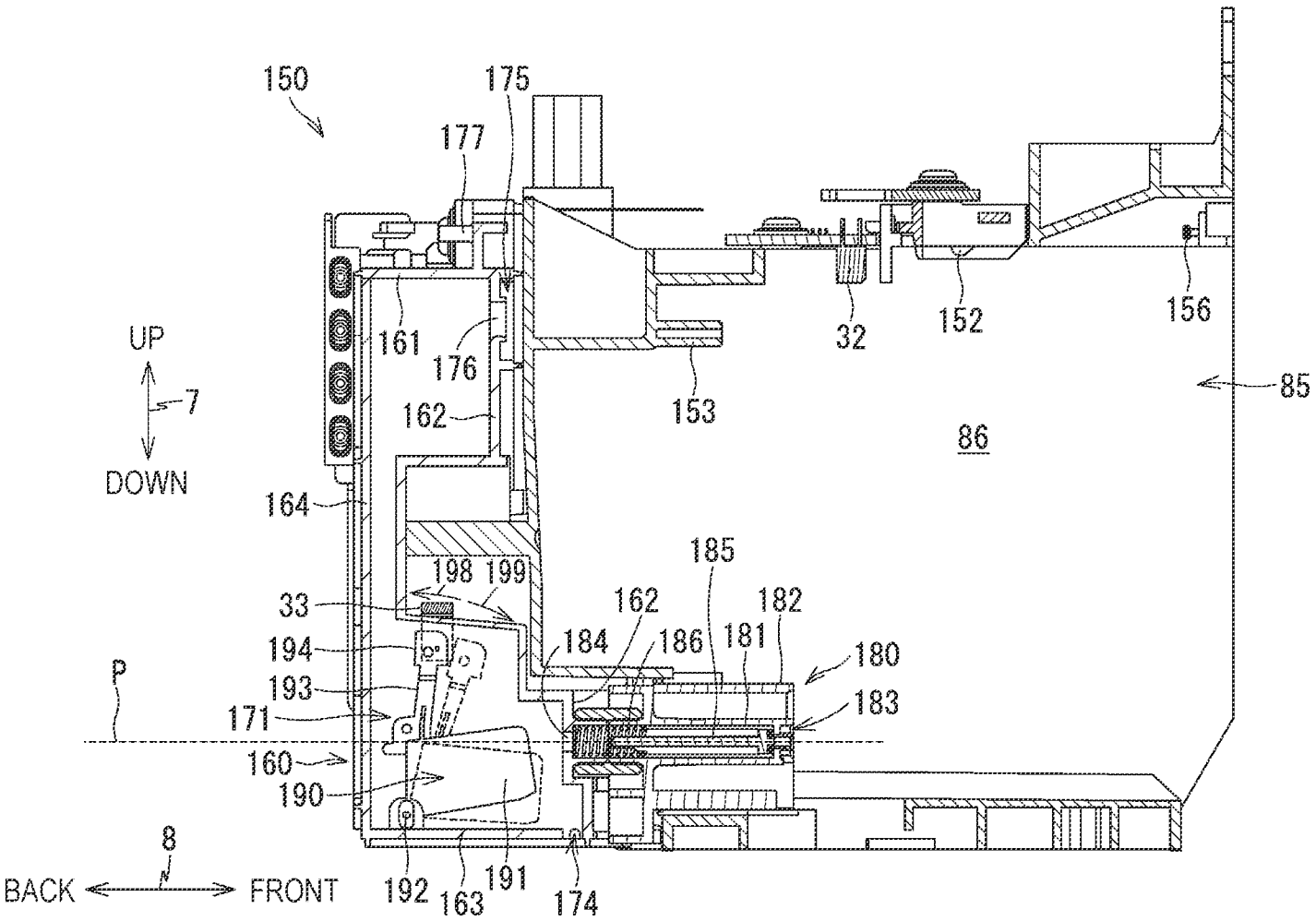
FIG. 4 is a longitudinal sectional view of an installation case.

As illustrated in FIG. 4, the installation case 150 includes a contact 152, a rod 153, an installation sensor 32, a liquid level sensor 33, and a lock pin 156. The installation case 150 can accommodate four cartridges 200 corresponding to respective colors of black, cyan, magenta, and yellow. That is, the installation case 150 includes four contacts 152, four rods 153, four installation sensors 32, and four liquid level sensors 33 corresponding to four cartridges 200. The number of the cartridges 200 which can be accommodated in the installation case 150 is not limited to four, and one cartridge or five or more cartridges may be accommodated.

The installation case 150 has a box shape having an internal space in which the installed cartridge 200 is accommodated. The internal space of the installation case 150 is defined by a top wall defining an upper end, a bottom wall defining a lower end, an inner wall defining a rear end in the front and back direction 8, and a pair of sidewalls defining both ends in the left and right direction 9. On the other hand, the opening 85 is located to face the inner wall of the installation case 150. That is, the opening 85 exposes the inner space of the installation case 150 to the outside of the printer 10 when the cover 87 is disposed at the open position.

Then, the cartridge 200 is installed in the installation case 150 through the opening 85 of the housing 14, and is pulled out of the installation case 150. More specifically, the cartridge 200 passes backwards through the opening 85 in the front and back direction 8, and is installed in the installation case 150. The cartridge 200 pulled out of the installation case 150 passes forward through the opening 85 in the front and back direction 8.

(Contact)

The contact 152 is located on the top wall of the installation case 150. The contact 152 protrudes downwardly toward the internal space of the installation case 150 from the top wall. The contact 152 is located so as to be in contact with an electrode 248 (to be described below) of the cartridge 200 in a state where the cartridge 200 is installed in the installation case 150. The contact 152 has conductivity and is elastically deformable along the up and down direction 7. The contact 152 is electrically connected to a controller 130.

(Rod)

The rod 153 protrudes forward from the inner wall of the installation case 150. The rod 153 is located above a joint 180 (to be described below) on the inner wall of the installation case 150. The rod 153 enters an air valve chamber 214 through an air communication port 221 (to be described below) of the cartridge 200 in the course of installing the cartridge 200 in the installation case 150. When the rod 153 enters the air valve chamber 214, the air valve chamber 214 (to be described below) communicates with the air.

(Installation Sensor)

The installation sensor 32 is located on the top wall of the installation case 150. The installation sensor 32 is a sensor for detecting whether the cartridge 200 is installed in the installation case 150. The installation sensor 32 includes a light emitting portion and a light receiving portion which are separated from each other in the left and right direction 9. In a state where the cartridge 200 is installed in the installation case 150, a light shielding rib 245 (to be described below) of the cartridge 200 is located between the light emitting portion and the light receiving portion of the installation sensor 32. In other words, the light emitting portion and the light receiving portion of the installation sensor 32 are located opposite to each other across the light shielding rib 245 of the cartridge 200 installed in the installation case 150.

The installation sensor 32 outputs a different signal (hereinafter referred to as "installation signal") depending on whether the light irradiated along the left and right direction 9 from the light emitting portion is received by the light receiving portion. The installation sensor 32 outputs a low-level signal to the controller 130 when an intensity of the light received by the light receiving portion is lower than threshold intensity, for example. Meanwhile, the installation sensor 32 outputs a high-level signal having higher signal intensity than the low-level signal to the controller 130 when the intensity of the light received by the light receiving portion is equal to or higher than the threshold intensity.

(Liquid Level Sensor)

The liquid level sensor 33 is a sensor for detecting whether a detection target portion 194 of an actuator 190 (to be described below) is located at a detection position. The liquid level sensor 33 includes a light emitting portion and a light receiving portion which are separated from each other in the left and right direction 9. In other words, when the detection target portion 194 is located at the detection position, the detection target portion 194 is located between the light emitting portion and the light receiving portion of the liquid level sensor 33. On the other hand, when the detection target portion 194 is not located at the detection position, the detection target portion 194 is located between the light emitting portion and the light receiving portion of the liquid level sensor 33. The liquid level sensor 33 outputs a different signal (hereinafter, referred to as "liquid level signal") depending on whether the light output from the light emitting portion is received by the light receiving portion. The liquid level sensor 33 outputs a low-level signal to the controller 130 when the intensity of the light received by the light receiving portion is lower than the threshold intensity, for example. Meanwhile, the liquid level sensor 33 outputs a high-level signal having higher signal intensity than the low-level signal to the controller 130 when the intensity of the light received by the light receiving portion is equal to or higher than the threshold intensity.

(Lock Pin)

The lock pin 156 is a rod-like member extending along the left and right direction 9 at the upper end of the internal space of the installation case 150 and in the vicinity of the opening 85. Both ends of the lock pin 156 in the left and right direction 9 are fixed to the pair of sidewalls of the installation case 150. The lock pin 156 extends in the left and right direction 9 across four spaces in which four cartridges 200 can be accommodated. The lock pin 156 is used to hold the cartridge 200 installed in the installation case 150 at an installation position illustrated in FIG. 6. The cartridge 200 is fixed to the lock pin 156 in the state of being installed in the installation case 150.

(Tank)

The printer 10 includes four tanks 160 corresponding to four cartridges 200. Specifically, the printer 10 includes a tank 160 in which a magenta ink is stored in correspondence to the cartridge 200 in which a magenta ink is stored, a tank 160 in which a cyan ink is stored in correspondence to the cartridge 200 in which a cyan ink is stored, a tank 160 in which a yellow ink is stored in correspondence to the cartridge 200 in which a yellow ink is stored, and a tank 160 in which a black ink is stored in correspondence to the cartridge 200 in which a black ink is stored. Four tanks 160 have substantially the common configuration, and one tank 160 will be described.

The tank 160 is located backwards from the inner wall of the installation case 150. As illustrated in FIG. 4, the tank 160 includes an upper wall 161, a front wall 162, a lower wall 163, a rear wall 164, and a pair of sidewalls (not illustrated). The front wall 162 includes a plurality of walls which deviate from each other in the front and back direction 8. A liquid chamber 171 is formed inside the tank 160. The liquid chamber 171 is an example of a second liquid chamber.

Among the walls forming the tank 160, at least the wall facing the liquid level sensor 33 has translucency. Thus, the light output from the liquid level sensor 33 can penetrate through the wall facing the liquid level sensor 33. At least a part of the rear wall 164 may be formed of a film welded to end faces of the upper wall 161, the lower wall 163, and the sidewall. In addition, the sidewall of the tank 160 may be common to the installation case 150 or may be independent of the installation case 150. Moreover, the tanks 160 adjacent to each other in the left and right direction 9 are partitioned by a partition wall (not illustrated).

The liquid chamber 171 communicates with an ink flow path (not illustrated) through an outflow port 174. A lower end of the outflow port 174 is defined by the lower wall 163 defining the lower end of the liquid chamber 171. The outflow port 174 is located below the joint 180 (more specifically, a lower end of a through hole 184). The ink flow path (not illustrated) communicating with the outflow port 174 communicates with the tube 19. Thus, the liquid chamber 171 communicates with the head 21 from the outflow port 174 through the ink flow path and the tube 19. That is, the ink stored in the liquid chamber 171 is supplied from the outflow port 174 to the head 21 through the ink flow path and the tube 19. In the ink flow path and the tube 19 communicating with the outflow port 174, one end (outflow port 174) communicates with the liquid chamber 171, and the other end 89 (see FIG. 3) communicates with the head 21.

The liquid chamber 171 communicates with the air through an air communication chamber 175. More specifically, the air communication chamber 175 communicates with the liquid chamber 171 through the through hole 176 penetrating the front wall 162. In addition, the air communication chamber 175 communicates with the outside of the printer 10 through an air communication port 177 and a tube (not illustrated) connected to the air communication port 177. That is, in the air communication chamber 175, one end (through hole 176) communicates with the liquid chamber 171 and the other end (air communication port 177) communicates with the outside of the printer 10. The air communication chamber 175 communicates with the air through the air communication port 177 and the tube (not illustrated).

(Joint)

As illustrated in FIG. 4, the joint 180 includes a needle 181 and a guide 182. The needle 181 is a tube in which a flow path is formed. The needle 181 protrudes forward from the front wall 162 defining the liquid chamber 171. An opening 183 is formed at a tip of the needle 181. In addition, the internal space of the needle 181 communicates with the liquid chamber 171 through the through hole 184 penetrating the front wall 162. In the needle 181, one end (opening 183) communicates with the outside of the tank 160, and the other end (through hole 184) communicates with the liquid chamber 171. The guide 182 is a cylindrical member disposed around the needle 181. The guide 182 protrudes forward from the front wall 162. A front end of the guide 182 is opened.

In the internal space of the needle 181, a valve 185 and a coil spring 186 are located. In the internal space of the needle 181, the valve 185 is movable between a closed position and an open position in the front and back direction 8. The valve 185 closes the opening 183 when being located at the closed position. Further, the valve 185 opens the opening 183 when being located at the open position. The coil spring 186 urges the valve 185 in a moving direction from the open position to the closed position, that is, forward in the front and back direction 8. The internal space of the needle 181 is one example of the flow path.

(Actuator)

As illustrated in FIG. 4, the actuator 190 is located in the liquid chamber 171. The actuator 190 is supported by a support member (not illustrated) disposed in the liquid chamber 171 so as to be rotatable in directions of arrows 198 and 199. The actuator 190 is rotatable between a position indicated by a solid line in FIG. 4 and a position indicated by a broken line. Further, the actuator 190 is prevented from rotating in the direction of the arrow 198 from the position of the solid line by a stopper (not illustrated; for example, an inner wall of the liquid chamber 171). The actuator 190 includes a float 191, a shaft 192, an arm 193, and a detection target portion 194. The actuator 190 is one example of a detection object.

The float 191 is formed of a material having a smaller specific gravity than the ink stored in the liquid chamber 171. The shaft 192 protrudes in the left and right direction 9 from right and left sides of the float 191. The shaft 192 is inserted into a hole (not illustrated) formed in the support member. Thus, the actuator 190 is supported by the support member so as to be rotatable around the shaft 192. The arm 193 extends substantially upwardly from the float 191. The detection target portion 194 is located at a tip of the arm 193. That is, the arm 193 is located between the detection target portion 194 and the shaft 192. The detection target portion 194 is a plate-like member extending in the up and down direction 7 and the front and back direction 8, respectively. The detection target portion 194 is formed of a material or color that shields the light output from the light emitting portion of the liquid level sensor 33.

When a liquid level of the ink stored in the liquid chamber 171 is equal to or higher than a reference position P, the actuator 190 rotated in the direction of the arrow 198 by buoyancy is held at the detection position indicated by the solid line in FIG. 4 by the stopper. On the other hand, when the liquid level of the ink is lower than the reference position P, the actuator 190 rotates in the direction of the arrow 199 as the liquid level lowers. Thus, the detection target portion 194 of the actuator 190 moves to a position out of the detection position. The detection target portion 194 is a portion of the actuator 190, and thus the detection target portion 194 moves to a position corresponding to the amount of ink stored in the liquid chamber 171.

The reference position P has the same height as an axial center of the needle 181 in the up and down direction 7, and has the same height as a center of an ink supply port 234 (to be described below). However, the reference position P is not limited to the position as long as it is located above the outflow port 174 in the up and down direction 7. As another example, the reference position P may have a height of the upper end or the lower end of the internal space of the needle 181, or may have a height of an upper end or a lower end of the ink supply port 234.

When the liquid level of the ink stored in the liquid chamber 171 is equal to or higher than the reference position P, the light output from the light emitting portion of the liquid level sensor 33 is blocked by the detection target portion 194 located at the detection position. Thus, since the light output from the light emitting portion does not reach the light receiving portion, the liquid level sensor 33 outputs a low-level signal to the controller 130. On the other hand, when the liquid level of the ink stored in the liquid chamber 171 is lower than the reference position P, since the light output from the light emitting portion reaches the light receiving portion, the liquid level sensor 33 outputs a high-level signal to the controller 130. That is, the controller 130 can detect from the signal output from the liquid level sensor 33 whether the liquid level of the ink stored in the liquid chamber 171 is equal to or higher than the reference position P. The reference position P is one example of a predetermined position. A low-level signal "L" is one example of a first signal, and a high-level signal "H" is one example of a second signal. Hereinafter, the low-level signal may be described as "L", and the high-level signal is described as "H" in some cases.

(Cartridge)

The cartridge 200 is a container including a liquid chamber 210 (see FIG. 3) which stores ink, which is a liquid, therein. The liquid chamber 210 is one example of a first liquid chamber. The cartridge 200 and the tank 160 are one example of a container set. The printer 10 includes a plurality of container sets which are a container set which stores a magenta ink, a container set which stores a cyan ink, a container set which stores a yellow ink, and a container set which stores a black ink.

Figure 5A:
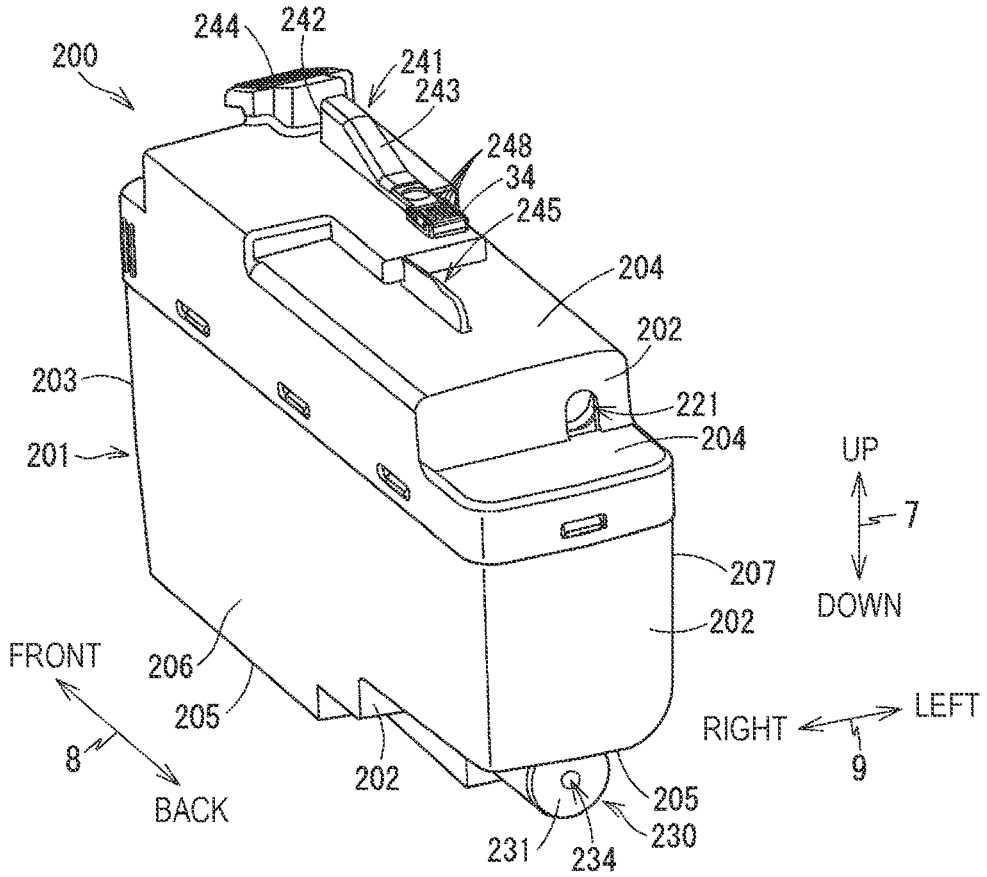

The liquid chamber 210 is defined by a resin wall, for example. As illustrated in FIG. 5A, the cartridge 200 has a flat shape in which dimensions in the up and down direction 7 and the front and back direction 8 are larger than a dimension in the left and right direction 9. The cartridges 200 capable of storing inks of other colors may have the same outer shape or different outer shapes. At least a part of the walls forming the cartridge 200 has translucency. Thus, a user can visually recognize the liquid level of the ink, which is stored in the liquid chamber 210 of the cartridge 200, from the outside of the cartridge 200.

The cartridge 200 includes a housing 201 and a supply tube 230. The housing 201 is formed with a rear wall 202, a front wall 203, an upper wall 204, a lower wall 205, and a pair of sidewalls 206 and 207. The rear wall 202 includes a plurality of walls that deviate from each other in the front and back direction 8. In addition, the upper wall 204 includes a plurality of walls that deviate from each other in the up and down direction 7. Further, the lower wall 205 includes a plurality of walls that deviate from each other in the up and down direction 7.

Figure 5B:
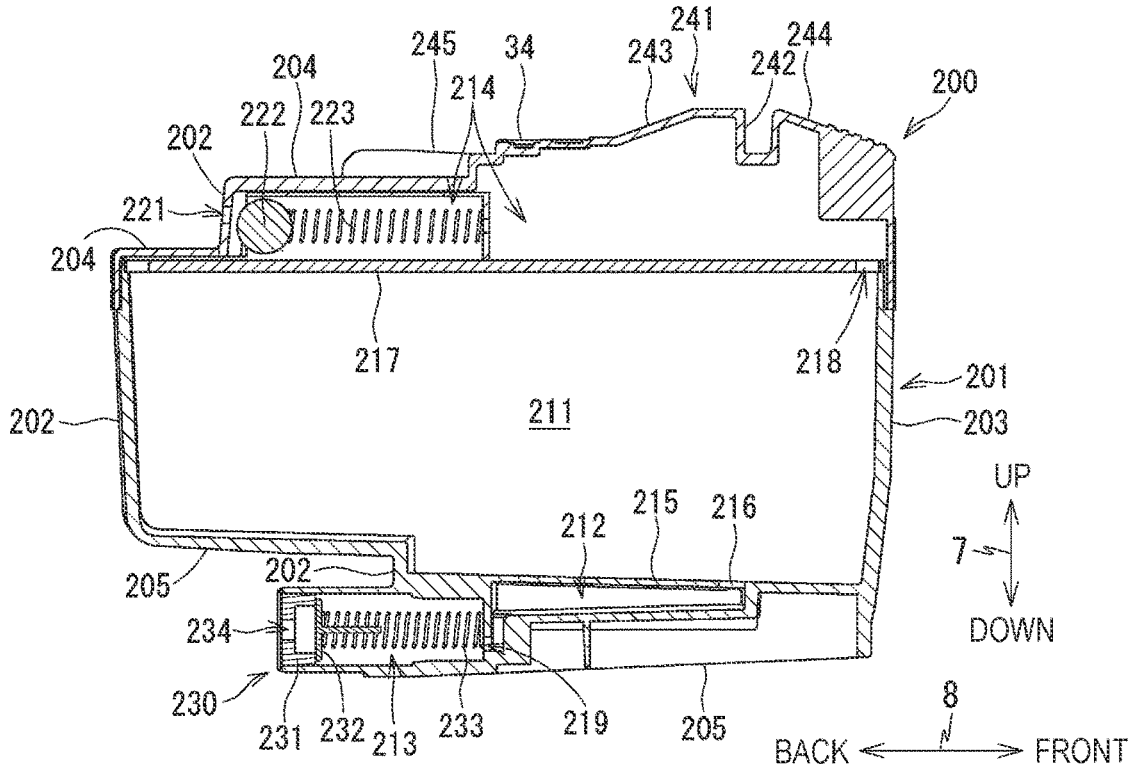

In the internal space of the cartridge 200, as illustrated in FIG. 5B, the liquid chamber 210, an ink valve chamber 213, and the air valve chamber 214 are formed. The liquid chamber 210 includes an upper liquid chamber 211 and a lower liquid chamber 212. The upper liquid chamber 211, the lower liquid chamber 212, and the air valve chamber 214 are internal spaces of the housing 201. On the other hand, the ink valve chamber 213 is an internal space of the supply tube 230. The liquid chamber 210 stores ink. The air valve chamber 214 allows the liquid chamber 210 and the outside of the cartridge 200 to communicate with each other.

The upper liquid chamber 211 and the lower liquid chamber 212 of the liquid chamber 210 are separated from each other in the up and down direction 7 by a partition wall 215 that partitions the internal space of the housing 201. Then, the upper liquid chamber 211 and the lower liquid chamber 212 communicate with each other through a through hole 216 formed in the partition wall 215. In addition, the upper liquid chamber 211 and the air valve chamber 214 are separated from each other by a partition wall 217 that partitions the internal space of the housing 201. Then, the upper liquid chamber 211 and the air valve chamber 214 communicate with each other through a through hole 218 formed in the partition wall 217. Further, the ink valve chamber 213 communicates with a lower end of the lower liquid chamber 212 through a through hole 219.

The air valve chamber 214 communicates with the outside of the cartridge 200 through the air communication port 221 formed in the rear wall 202 at the upper part of the cartridge 200. That is, in the air valve chamber 214, one end (through hole 218) communicates with the liquid chamber 210 (more specifically, the upper liquid chamber 211), and the other end (air communication port 221) communicates with the outside of the cartridge 200. The air valve chamber 214 communicates with the air through the air communication port 221. In addition, a valve 222 and a coil spring 223 are located in the air valve chamber 214. The valve 222 is movable between a closed position and an open position in the front and back direction 8. When being located at the closed position, the valve 222 closes the air communication port 221. Further, when being located at the open position, the valve 222 opens the air communication port 221. The coil spring 223 urges the valve 222 in a moving direction from the open position to the closed position, that is, backward in the front and back direction 8.

The rod 153 enters the air valve chamber 214 through the air communication port 221 in the course of installing the cartridge 200 in the installation case 150. The rod 153 having entered the air valve chamber 214 moves the valve 222 located at the closed position against an urging force of the coil spring 223 forward in the front and back direction 8. Then, as the valve 222 moves to the open position, the upper liquid chamber 211 communicates with the air. The configuration for opening the air communication port 221 is not limited to the above example. As another example, a configuration may be adopted in which the rod 153 breaks through a film that seals the air communication port 221.

The supply tube 230 protrudes in the lower part of the housing 201 from the rear wall 202 backward in the front and back direction 8. The rear end of the supply tube 230 is opened. That is, the ink valve chamber 213 allows the liquid chamber 210 communicating through the through hole 219 and the outside of the cartridge 200 to communicate with each other. In the ink valve chamber 213, one end (through hole 219) communicates with the liquid chamber 210 (more specifically, the lower liquid chamber 212), and the other end (ink supply port 234 (to be described below)) communicates with the outside of the cartridge 200. In addition, in the ink valve chamber 213, a packing 231, a valve 232, and a coil spring 233 are located.

At the center of the packing 231, the ink supply port 234 penetrating in the front and back direction 8 is formed. An inner diameter of the ink supply port 234 is slightly smaller than an outer diameter of the needle 181. The valve 232 is movable between a closed position and an open position in the front and back direction 8. When being located at the closed position, the valve 232 comes in contact with the packing 231 and closes the ink supply port 234. Further, when being located at the open position, the valve 232 separates from the packing 231 and opens the ink supply port 234. The coil spring 233 urges the valve 232 in a moving direction from the open position to the closed position, that is, backward in the front and back direction 8. In addition, the urging force of the coil spring 233 is larger than that of the coil spring 186.

The supply tube 230 enters the guide 182 in the course of installing the cartridge 200 in the installation case 150, and the needle 181 eventually enters the ink valve chamber 213 through the ink supply port 234. At this time, the needle 181 makes liquid-tight contact with the inner peripheral surface defining the ink supply port 234 while elastically deforming the packing 231. When the cartridge 200 is further inserted into the installation case 150, the needle 181 moves forward the valve 232 against an urging force of the coil spring 233. In addition, the valve 232 moves backward the valve 185 protruding from the opening 183 of the needle 181 against the urging force of the coil spring 186.

Figure 6:
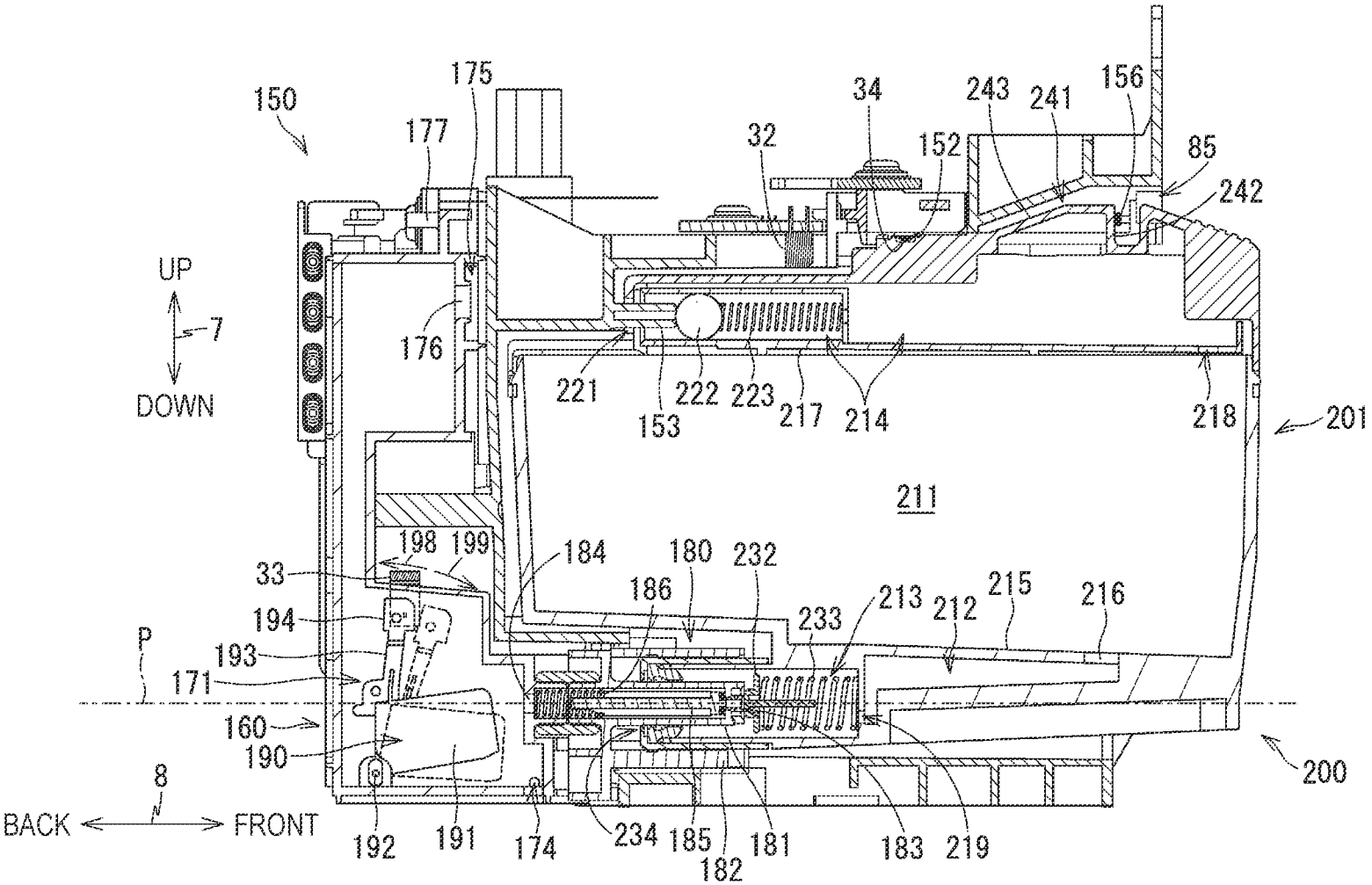
FIG. 6 is a longitudinal sectional view illustrating a state where the cartridge is installed in the installation case.

Thus, as illustrated in FIG. 6, the ink supply port 234 and the opening 183 are opened, and the ink valve chamber 213 of the supply tube 230 communicates with the internal space of the needle 181. That is, in a state where the cartridge 200 is installed in the installation case 150, the ink valve chamber 213 and the internal space of the needle 181 form a flow path through which the liquid chamber 210 of the cartridge 200 communicates with the liquid chamber 171 of the tank 160.

In a state where the cartridge 200 is installed in the installation case 150, a part of the liquid chamber 210 and a part of the liquid chamber 171 overlap each other when viewed in the horizontal direction. Further, the bottom part of the liquid chamber 171 is located below the bottom part of the liquid chamber 210. As a result, the ink stored in the liquid chamber 210 moves to the liquid chamber 171 of the tank 160 due to a difference between the water head of the ink stored in the liquid chamber 210 and the water head of the ink stored in the liquid chamber 171 through the supply tube 230 and the joint 180 which are connected.

As illustrated in FIGS. 5A and 5B, a projection 241 is formed on the upper wall 204. The projection 241 protrudes upward from the outer surface of the upper wall 204 and extends in the front and back direction 8. The projection 241 includes a lock surface 242 and an inclined surface 243. The lock surface 242 and the inclined surface 243 are located above the upper wall 204. The lock surface 242 is directed to the front side in the front and back direction 8 and extends in the up and down direction 7 and the left and right direction 9, respectively (that is, being substantially orthogonal to the upper wall 204). The inclined surface 243 is inclined with respect to the upper wall 204 so as to be directed upward and backward.

The lock surface 242 is a surface to be brought into contact with the lock pin 156 in a state where the cartridge 200 is installed in the installation case 150. The inclined surface 243 is a surface for guiding the lock pin 156 to a position where the lock pin comes in contact with the lock surface 242 in the course of installing the cartridge 200 in the installation case 150. In a state where the lock surface 242 and the lock pin 156 are in contact with each other, the cartridge 200 is held at the installation position illustrated in FIG. 6 against the urging force of the coil springs 186, 223, and 233.

A flat plate-like member is formed in front of the lock surface 242 so as to extend upward from the upper wall 204. An upper surface of the flat plate-like member corresponds to an operation portion 244 to be operated by a user when the cartridge 200 is removed from the installation case 150. When the cartridge 200 is installed in the installation case 150, and the cover 87 is located at the open position, the operation portion 244 can be operated by the user. When the operation portion 244 is pushed downward, the cartridge 200 rotates, and thus the lock surface 242 moves downward from the lock pin 156. As a result, the cartridge 200 can be removed from the installation case 150.

As illustrated in FIGS. 5A and 5B, the light shielding rib 245 is formed on the outer surface of the upper wall 204 and behind the projection 241. The light shielding rib 245 protrudes upward from the outer surface of the upper wall 204 and extends in the front and back direction 8. The light shielding rib 245 is formed of a material or color that shields the light output from the light emitting portion of the installation sensor 32. The light shielding rib 245 is located on an optical path extending from the light emitting portion to the light receiving portion of the installation sensor 32 in a state where the cartridge 200 is installed in the installation case 150. That is, the installation sensor 32 outputs a low-level signal to the controller 130 (FIGS. 1A and 1B) when the cartridge 200 is installed in the installation case 150. On the other hand, the installation sensor 32 outputs a high-level signal to the controller 130 when the cartridge 200 is not installed in the installation case 150. That is, the controller 130 can detect whether the cartridge 200 is installed in the installation case 150, depending on a signal output from the installation sensor 32.

As illustrated in FIGS. 5A and 5B, an IC chip 34 is located on the outer surface of the upper wall 204 and between the light shielding rib 245 and the projection 241 in the front and back direction 8. On the IC chip 34, an electrode 248 is formed. In addition, the IC chip 34 includes a memory (not illustrated). The electrode 248 is electrically connected to the memory of the IC chip 34. The electrode 248 is exposed on an upper surface of the IC chip 34 so as to be electrically connectable with the contact 152. That is, the electrode 248 is electrically connected to the contact 152 in a state where the cartridge 200 is installed in the installation case 150. The controller 130 can read information from the memory of the IC chip 34 through the contact 152 and the electrode 248, and can write information to the memory of the IC chip 34 through the contact 152 and the electrode 248.

The memory of the IC chip 34 stores identification information, a serial number, and a cartridge residual-amount value of the cartridge 200. The identification information is information that indicates whether the cartridge 200 is a small-volume cartridge or a large-volume cartridge, the color of the stored ink, and the like. The serial number is information for identifying the individual of the cartridge 200. The cartridge residual-amount value is a value that indicates the amount of the ink stored in the cartridge 200.

(Controller)

The printer 10 includes the controller 130. As illustrated in FIGS. 1A and 1B, the controller 130 includes a CPU 35, a storage part 36, and a communication bus 39. The storage part 36 includes a ROM 37, an EEPROM 51, and a RAM 52. The controller 130 is one example of a first controller.

The ROM 37 stores an OS (the abbreviation for Operating System) program 37A, a control program 37B, a communication program 37C, or the like. The control program 37B is a program which performs a printing process (to be described later) or the like. The communication program 37C is a program which controls the communication with external equipment such as the information collection server 40. An OS program 37A is a program different from the control program 37B, and further is a program which controls an operation different from the operation controlled by the communication program 37C. The OS program 37A, the control program 37B, and the communication program 37C are executed when the command described in an address is processed by the CPU 35. Hereinafter, the operation which is processed by executing the OS program 37A, the control program 37B, and the communication program 37C may be described as the operation of the controller 130 in some cases. The controller 130 may have a hardware circuit which uses an IC which implements the partial or entire operation executed by the OS program 37A, the control program 37B, and the communication program 37C.

The EEPROM 51 stores the device information of the printer 10. The device information includes a model name of the printer 10 or identification information of the printer 10. The identification information of the printer 10 is a MAC address or a serial number of the printer 10. In addition, the EEPROM 51 stores an initial filling value corresponding to the identification information stored in the IC chip 34 of the cartridge 200. The respective initial filling value means an amount (hereinafter, also referred to as an initial filling amount) of the liquid with which the liquid chamber 210 is filled at the time of manufacturing a new cartridge 200. For example, the EEPROM 51 stores an initial filling value in which the identification information corresponds to the small-volume cartridge and an initial filling value in which the identification information corresponds to the large-volume cartridge. Further, the EEPROM 51 stores an initial filling value in which the identification information corresponds to, for example, colors (cyan, magenta, and yellow) and an initial filling value in which the identification information corresponds to, for example, black. That is, the EEPROM 51 stores two kinds (small-volume cartridge or large-volume cartridge) of initial filling values with respect to colors, and stores two kinds (small-volume cartridge or large-volume cartridge) of initial filling values with respect to black.

The communication bus 39 is connected with the head 21, a communication interface (hereinafter referred to as a communication I/F) 31, the installation sensor 32, the liquid level sensor 33, the contact 152, a clock 30, the display 28, the motor (not illustrated), and the like. The clock 30 outputs date/time information. The communication I/F 31 is connected to the communication line 6. The communication I/F 31 is one example of a first communication interface.

The controller 130 rotates the feed roller 23, the conveyance roller 25, and the discharge roller 27 by driving the motor (not illustrated) through the communication bus 39. In addition, the controller 130 outputs a driving signal to a driving element of the head 21 through the communication bus 39, thereby causing the head 21 to discharge ink droplets.

The controller 130 detects through the installation sensor 32 whether the cartridge 200 is installed in the installation case 150. Further, the controller 130 detects through the liquid level sensor 33 whether the liquid level of the ink stored in the liquid chamber 171 is equal to or higher than the reference position P.

The controller 130 reads the identification information, the serial number, and the cartridge residual-amount value stored in the memory of the IC chip 34 through the electrode 248 of the cartridge 200 installed in the installation case 150, and the contact 152. Further, the controller 130 updates the value of the cartridge residual-amount value stored in the memory of the IC chip 34 through the electrode 248 of the cartridge 200 installed in the installation case 150, and the contact 152.

(Information Collection Server)

The information collection server 40 may be installed on the communication line 6 such as the Internet by a vendor of the printer 10, and may be installed by a business operator different from the vendor. The information collection server 40 includes a CPU 41, a storage part 42, a communication interface 43 for printer (hereinafter, referred to as a communication I/F 43), a communication interface 44 for ordering server (hereinafter, referred to as a communication I/F 44), a communication bus 49, and a clock 48. The CPU 41, the storage part 42, and the communication bus 49 constitutes a controller 45. The clock 48 outputs date/time information. The communication I/F 43 is connected to the communication line 6, and communicates with the printer 10 or the ordering server 50. The controller 45 is one example of a second controller. The communication I/F 43 for printer is one example of the second communication I/F. The communication I/F 44 for ordering server is one example of a third communication I/F.

The storage part 42 has a program storage region 46 and a data storage region 47. The program storage region 46 is a hard disk or the like. The data storage region 47 is an RAM, a hard disk, or the like.

The program storage region 46 stores programs such as an OS program 46A, a control program 46B, and a communication program 46C. The control program 46B executes a process (to be described later). The communication program 46C controls communication with the printer 10 or the ordering server 50. The OS program 46A is different from the control program 46B and performs the control different from the communication program 46C. Hereinafter, the OS program 46A, the control program 46B, and the communication program 46C are executed when a command is copied to the RAM from the hard disk, the CPU 41 sequentially executes the command copied to the RAM. Hereinafter, the operation which is processed by executing the OS program 46A, the control program 46B, and the communication program 46C may be described as the operation of the controller 45 or the information collection server 40 in some cases.

(Ordering Server)

The ordering server 50 may be installed on the communication line 6 such as the Internet by a vendor of the printer 10, and may be installed by a business operator different from the vendor. The ordering server 50 offers a service to send the cartridge 200 to the user of the printer 10 in response to the demand from the information collection server 40.

(Ink Management by Ordering System)

In the ordering system 5, the information collection server 40 collects the management information including information on the residual amount of the ink from the printer 10, and places an order of the cartridge 200 with respect to the ordering server 50 when the residual amount of the ink is small. As described above, the information collection server 40 performs the management of the residual ink amount and the ordering of the cartridge 200, thereby saving the labor of the user of the printer 10 for the management of the residual ink amount and the purchase of the cartridge 200.

Specifically, the user of the printer 10 makes a contract with a manufacturer who performs the management of the residual ink amount and the ordering service of the cartridge 200. The management of the residual ink amount and the ordering service of the cartridge 200 are services contracted with each of printers. At the time of contracting, the user information or the identification information of the printer 10 which is a contract object is registered in the information collection server 40. The user information is destination information such as a name and an address of a user of a delivery destination of the cartridge 200. The identification information is information for identifying the individual of the printer 10 as the contract object and is a serial number, a MAC address, or the like of the printer 10. In addition, the identification information of the printer 10 and the user information are registered in correlation with each other in the information collection server 40. Hereinafter, the processes of the printer 10, the information collection server 40, and the ordering server 50 regarding the ordering of the cartridge 200 will be described in detail.

(Process Executed by Controller of Printer)

The process executed by the controller 130 of the printer 10 is described with reference to the flowcharts illustrated in FIGS. 7 to 9. Execution orders of the following processes can be appropriately changed within the range of the scope of the disclosure.

(Printing Process)

Figure 7:
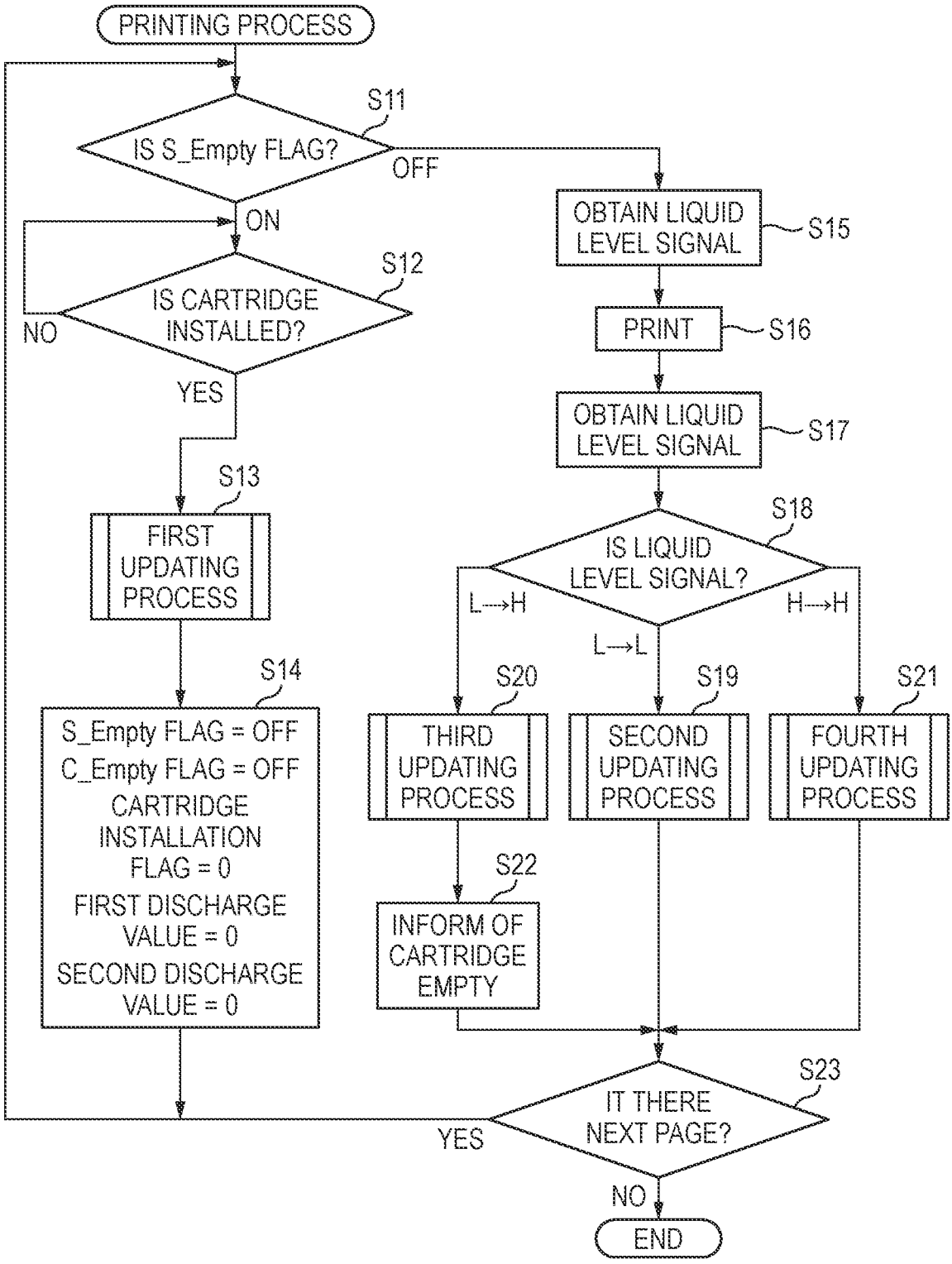
FIG. 7 is a flowchart of a printing process.

The controller 130 executes a printing process illustrated in FIG. 7 in response to a printing instruction input to the printer 10. An acquisition destination of the printing instruction is not particularly limited, but, for example, a user's operation corresponding to the printing instruction may be accepted through an operation panel 22 or the display 28, or may be received from an external device through the communication I/F 31. The printing instruction is an example of a discharge instruction. The printing instruction includes image data indicating an image. The image data is stored in the RAM 52 of the printer 10.

First, the controller 130 determines whether a value of an S_Empty flag stored in the EEPROM 51 is "ON" or "OFF" (S11). Before the liquid level of the ink stored in the liquid chamber 171 of the tank 160 reaches the upper end of the outflow port 174 through which the ink flows out from the tank 160, the controller 130 stores "ON" in the S_Empty flag of the EEPROM 51. The value of the S_Empty flag of the EEPROM 51 is stored as "OFF" until being stored as "ON". When the liquid level of the ink reaches the upper end of the outflow port 174, there is a concern that air enters the nozzle of the head 21. When the air having entered the nozzle of the head 21 remains in the nozzle, the concern that the ink is prevented from entering the nozzle, or the ink droplets is prevented from being discharged from the nozzle is created.

That is, the S_Empty flag is intended to prevent the air from entering the nozzle of the head 21. The controller 130 stores "OFF" in the S_Empty flag of the EEPROM 51 in step S14 (to be described later), and stores "ON" in the S_Empty flag of the EEPROM 51 in step S55. Although not illustrated in the flowchart, the controller 130 prohibits the discharge of the ink through the head 21 when the value of the S_Empty flag of the EEPROM 51 is "ON". In addition, when the value of the S_Empty flag of the EEPROM 51 is "OFF", the controller 130 allows the ink to be discharged through the head 21.

When it is determined that the value of the S_Empty flag of the EEPROM 51 is "ON" (S11: ON), the controller 130 obtains an installation signal from the installation sensor 32 at predetermined time intervals. Next, the controller 130 determines whether the obtained installation signal changes from the low-level signal (hereinafter, referred to as "L") to the high-level signal (hereinafter, referred to as "H"), and the obtained installation signal changes from "H" to "L" (S12). That is, whether the cartridge 200 is installed is determined by the change of the installation signal. Hereinafter, by determining whether the obtained installation signal changes from "L" to "H", and the obtained installation signal changes from "H" to "L", the controller 130 determines whether the cartridge 200 is installed. In addition, when the controller 130 determines that the obtained installation signal changes from "L" to "H", and the obtained installation signal changes from "H" to "L" (S12: Yes), it is considered that the controller 130 determines that the cartridge 200 is installed.

When the controller 130 determines that the cartridge 200 is not installed (S12: No), the installation signal is continuously obtained regularly from the installation sensor 32. When it is determined that the cartridge 200 is installed (S12: Yes), the controller 130 executes a first updating process (S13). The process of step S12 is exemplified as a specific example in which the controller 130 determines whether the cartridge 200 is installed, but the disclosure is not limited thereto. For example, whether the cartridge 200 is installed may be determined by using the serial number. The controller 130 reads the serial number of the cartridge 200 from the memory of the IC chip 34 of the cartridge 200. Then, the controller 130 determines whether the read serial number and the serial number stored in the EEPROM 51 coincide with each other. The serial number stored in the EEPROM 51 indicates a serial number which is stored in the memory of the IC chip 34 of the cartridge 200 which is installed in the installation case 150 before a new cartridge 200 is installed in the installation case 150. In that case, in a specific example in which the controller determines that the cartridge 200 is installed, the controller 130 determines that the serial number read from the memory of the IC chip 34 and the serial number stored in the EEPROM 51 do not coincide with each other.

(First Updating Process)

Figure 8A:
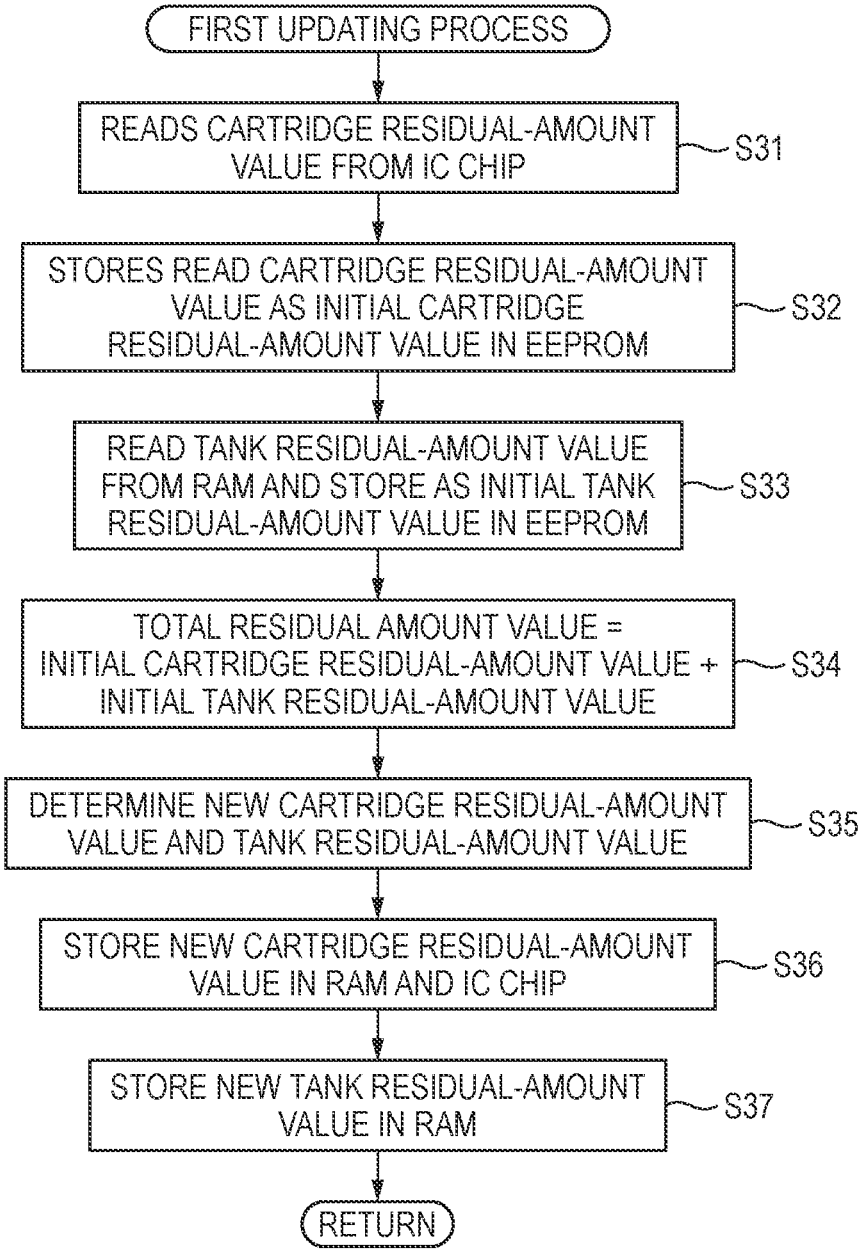
FIG. 8A is a flowchart of a first updating process.

The first updating process illustrated in FIG. 8A is a process that the controller 130 updates an initial cartridge residual-amount value and an initial tank residual-amount value stored in the EEPROM 51, and the cartridge residual-amount value stored in the IC chip 34 of the cartridge 200.

First, the controller 130 reads the cartridge residual-amount value stored in the memory of the IC chip 34 from the memory of the IC chip 34 of the cartridge 200 installed in the installation case 150 through the contact 152 (S31). The controller 130 stores the read cartridge residual-amount value as the initial cartridge residual-amount value in the EEPROM 51 (S32).

The controller 130 reads the tank residual-amount value from the RAM 52 (S33). When the tank residual-amount value is not stored in the RAM 52 due to the power-off or the like, similarly to a fourth updating process (to be described later), the controller 130 calculates the tank residual-amount value and stores the calculated tank residual-amount value in the RAM 52. The tank residual-amount value read from the RAM 52 is a value indicating the residual ink amount which is stored in the liquid chamber 171 of the tank 160 immediately before the cartridge 200 is installed. In other words, the tank residual-amount value is a value indicating the residual ink amount which is stored in the liquid chamber 171 of the tank 160 when the cartridge 200 is pulled. The controller 130 stores the tank residual-amount value read from the RAM 52 as the initial tank residual-amount value in the EEPROM 51 (S33).

The controller 130 adds the initial cartridge residual-amount value and the initial tank residual-amount value, and calculates a total residual amount value indicating the total residual amount of the ink (S34). The controller 130 determines a new cartridge residual-amount value and a new tank residual-amount value from the calculated total residual amount value (S35).

Specifically, when a new cartridge 200 is installed in the installation case 150, the ink stored in the liquid chamber 210 of the cartridge 200 partially flows out to the liquid chamber 171 of the tank 160. The flow-out of the ink from the liquid chamber 210 of the cartridge 200 to the liquid chamber 171 of the tank 160 is stopped when there is almost no difference between the water head of the ink stored in the liquid chamber 210 of the cartridge 200 and the water head of the ink stored in the liquid chamber 171 of the tank 160. The new cartridge residual-amount value and the new tank residual-amount value indicate residual ink amounts in a state where there is almost no difference between the water head of the ink stored in the liquid chamber 210 of the cartridge 200 and the water head of the ink stored in the liquid chamber 171 of the tank 160.

The cartridge residual-amount value and the tank residual-amount value may be determined by calculation of the controller 130 based on a formula stored in the EEPROM 51 or the ROM 37, for example. Otherwise, the cartridge residual-amount value and the tank residual-amount value may be determined based on a table stored in the EEPROM 51 or the ROM 37 by the controller 130, for example. Specifically, the shape of the liquid chamber 210 of the cartridge 200 and the shape of the liquid chamber 171 of the tank 160 are predetermined by designing. Therefore, when the total residual amount value of the ink is determined, the cartridge residual-amount value and the tank residual-amount value are also determined in a state where there is almost no difference between the water head of the ink stored in the liquid chamber 210 of the cartridge 200 and the water head of the ink stored in the liquid chamber 171 of the tank 160. The EEPROM 51 or the ROM 37 stores a formula for calculating the cartridge residual-amount value and the tank residual-amount value from the total residual amount value in advance. Otherwise, the EEPROM 51 or the ROM 37 stores a table which indicates a correlation among the total residual amount value, the cartridge residual-amount value, and the tank residual-amount value in advance. The controller 130 determines the new cartridge residual-amount value and the new tank residual-amount value based on the total residual amount value of the ink and the formula or the table.

The controller 130 stores the determined new cartridge residual-amount value in the RAM 52 and the IC chip 34 (S36). In addition, the controller 130 stores the determined new tank residual-amount value in the RAM 52 (S37), and ends the first updating process.

The controller 130 stores the determined new cartridge residual-amount value in the RAM 52 and updates the cartridge residual-amount value stored in the memory of the IC chip 34 (S36). In addition, the controller 130 stores the determined new tank residual-amount value in the RAM 52 (S37), and ends the first updating process.

As illustrated in FIG. 7, when the first updating process ends (S13), the controller 130 stores "OFF" in the S_Empty flag of the EEPROM 51, stores "OFF" in a C_Empty flag of the EEPROM 51, stores "ON" in a cartridge installation flag of the EEPROM 51, and stores zero as a first discharge value and a second discharge value of the EEPROM 51 (S14). The controller 130 executes the process of step S11 again after execution of the process of step S14. The C_Empty flag, the first discharge value, the second discharge value, and the cartridge installation flag will be described below.

When it is determined that the value of the S_Empty flag of the EEPROM 51 is "OFF" (S11: OFF), the controller 130 obtains a signal (hereinafter, referred to as the liquid level signal) from the liquid level sensor 33 (S15). Thereafter, the controller 130 performs printing on the sheet according to the image data stored in the RAM 52 (S16). The ink is discharged through the head 21 when the image is printed on the sheet. When the ink is discharged, the liquid level of the ink in the tank 160 is lowered. The controller 130 obtains the liquid level signal from the liquid level sensor 33 after execution (S16) of the printing (S17). Next, the controller 130 determines the liquid level signal obtained in step S15 and the liquid level signal obtained in step S17 (S18). Hereinafter, in the controller 130, the low-level signal obtained from the liquid level sensor 33 may be described as "L". In addition, in the controller 130, the high-level signal obtained from the liquid level sensor 33 may be described as "H".

The controller 130 executes a second updating process (S19) when it is determined that all the liquid level signals obtained in steps S15 and S17 are "L" (S18: L→L). In step S18, when the controller 130 determines that the liquid level signals obtained in steps S15 and S17 are "L", the ink stored in the liquid chamber 171 of the tank 160 is in the following state. That is, the position of the liquid level of the ink stored in the liquid chamber 171 of the tank 160 before the execution (S16) of the printing is equal to or higher than the reference position P (the liquid level signal obtained in step S15 is "L"). Further, the position of the liquid level of the ink is stored in the liquid chamber 171 of the tank 160 after the execution (S16) of the printing is equal to or higher than the reference position P (the liquid level signal obtained in step S17 is "L"). That is, after execution (S16) of the printing, the ink is present in the liquid chamber 210 of the cartridge 200 when the liquid level signal which the controller 130 obtains in step S17 is "L".

(Second Updating Process)

Figure 8B:
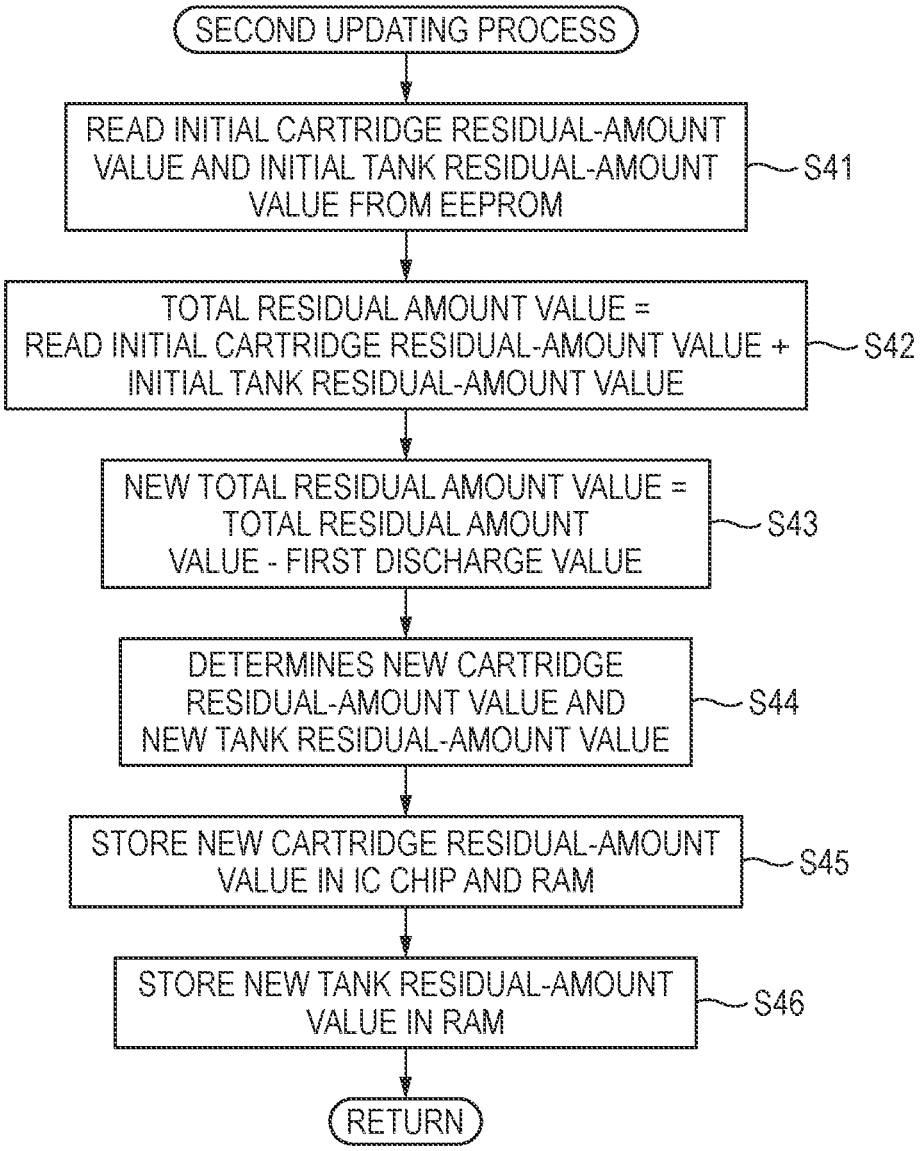
FIG. 8B is a flowchart of a second updating process.

The second updating process illustrated in FIG. 8B is a process that the controller 130 determines a new cartridge residual-amount value and a new tank residual-amount value from the first discharge value indicating the amount of the ink which is discharged through the head 21 at the printing or maintenance. For example, the first discharge value is a value obtained by multiplying the amount of one droplet of the ink discharged to the head 21 by the number of discharging the one droplet of the ink. The controller 130 instructs the head 21 to discharge the ink to count the first discharge value corresponding to the instruction. The controller 130 counts the first discharge value corresponding to the amount of the ink which the head 21 discharges until the present time since the cartridge 200 is installed. That is, the first discharge value is an integration value of the amount of the ink which the head 21 discharges until the present time since the cartridge 200 is installed. The first discharge value is stored in the EEPROM 51.

First, the controller 130 reads the initial cartridge residual-amount value and the initial tank residual-amount value from the EEPROM 51 (S41). Next, the controller 130 calculates a total residual amount value by adding the read initial cartridge residual-amount value and the read initial tank residual-amount value (S42). The controller 130 calculates a new total residual amount value by subtracting the first discharge value from the calculated total residual amount value (S43). Thereafter, similarly to the above description, the controller 130 determines the new cartridge residual-amount value and the new tank residual-amount value by using the formula or the table (S44).

The controller 130 stores the determined new cartridge residual-amount value in the RAM 52 and updates the cartridge residual-amount value stored in the memory of the IC chip 34 (S45). In addition, the controller 130 stores the determined new tank residual-amount value in the RAM 52 (S46), and ends the second updating process.

As illustrated in FIG. 7, when the second updating process (S19) ends, the controller 130 determines whether the image data on the next page is stored in the RAM 52 (S23). When it is determined that the image data on the next page is stored in the RAM 52 (S23: Yes), the controller 130 executes the process of step S11 again. When it is determined that the image data on the next page is not stored in the RAM 52 (S23: No), the controller 130 ends the printing process.

The above-described determining method of the cartridge residual-amount value and the tank residual-amount value is merely one example. The cartridge residual-amount value and the tank residual-amount value may be determined by another method.

When it is determined that the value of the S_Empty flag of the EEPROM 51 is "OFF" (S11: OFF), the controller 130 executes the processes of steps S15 to S18 again. When it is determined that the liquid level signal obtained in step S15 is "L", and the liquid level signal obtained in step S17 is "H" (S18: L→H), the controller 130 executes a third updating process (S20). In step S18, when the controller 130 determines that the liquid level signal obtained in step S15 is "L", and the liquid level signal obtained in S17 is "H", the ink stored in the liquid chamber 171 of the tank 160 is in the following state. That is, the position of the liquid level of the ink stored in the liquid chamber 171 of the tank 160 before execution (S16) of the printing is equal to or higher than the reference position P (the liquid level signal obtained in step S15 is "L"). Further, the position of the liquid level of the ink stored in the liquid chamber 171 of the tank 160 after execution (S16) of the printing is lower than the reference position P (the liquid level signal obtained in step S17 is "H"). That is, it means that the ink having been in the liquid chamber 210 of the cartridge 200 during the execution (S16) of the printing is not present. In other words, it means that the ink which is stored in the liquid chamber 210 of the cartridge 200 during the execution (S16) of the printing is used up.

(Third Updating Process)

Figure 8C:
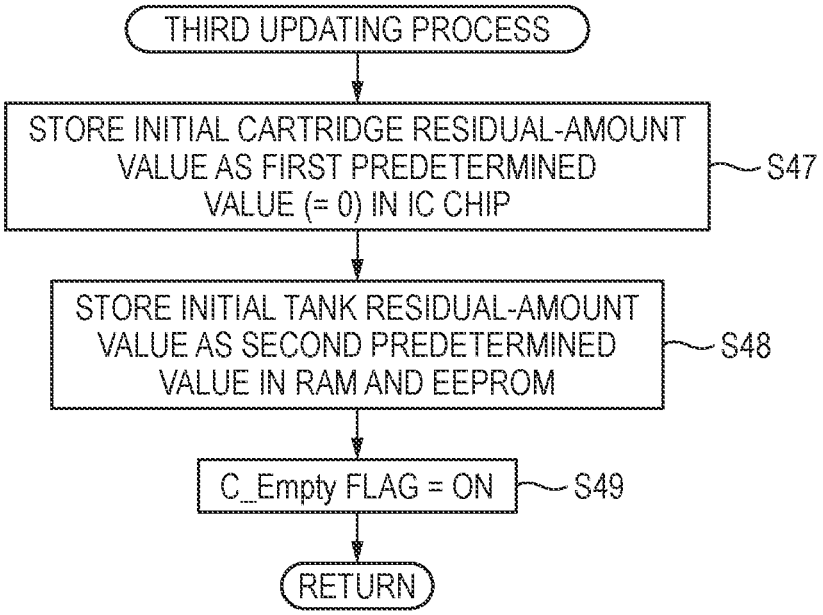
FIG. 8C is a flowchart of a third updating process.

The third updating process illustrated in FIG. 8C is a process that the controller 130 updates the initial cartridge residual-amount value as a first predetermined value and updates the initial tank residual-amount value as a second predetermined value. Specifically, the first discharge value which indicates the amount of the ink which is discharged through the head 21 for the printing or the like includes errors. For example, although the controller 130 instructs the head 21 to discharge a specified amount of the ink, the amount of the ink which is actually discharged through the head 21 is different from the specified amount instructed to the head 21 in some cases. For example, this difference may result from the temperature at the time of instructing the discharge of the ink. Since the viscosity of ink increases as the temperature is lowered, and the ink is hard to be discharged through the nozzle 29. Further, when the controller 130 repeatedly issues the above instruction to the head 21, the difference between the amount of the ink which is actually discharged through the head 21 repeatedly and the repeated amount of the specified amount may become larger. That is, there is a possibility that errors in the amount indicated by the calculated first discharge value and the amount which is actually discharged through the head 21 are integrated every time of printing.

Since the cartridge residual-amount value is determined based on the first discharge value, errors occur between the residual ink amount indicated by the cartridge residual-amount value and the actual residual ink amount stored in the liquid chamber 210. In addition, since the tank residual-amount value is determined based on the first discharge value, errors occurs between the residual ink amount indicated by the tank residual-amount value and the actual residual ink amount stored in the liquid chamber 171. Therefore, the cartridge residual-amount value and the tank residual-amount value which are determined every time of printing include integrated errors. The third updating process is a process that resets the integrated errors.

Specifically, the controller 130 updates the initial cartridge residual-amount value stored in the memory of the IC chip 34 as the first predetermined value (S47). For example, the first predetermined value is "zero". In addition, the controller 130 stores the initial tank residual-amount value as the second predetermined value in the RAM 52 and the EEPROM 51 (S48). The second predetermined value is a value which indicates the amount of the ink stored in the liquid chamber 171 of the tank 160 when the liquid level of the ink is at the reference position P. For example, the first predetermined value and the second predetermined value are stored in the ROM 37 in advance.

Next, the controller 130 stores "ON" in the C_Empty flag of the EEPROM 51 (S49) and ends the third updating process.

As illustrated in FIG. 7, when the third updating process (S20) ends, the controller 130 informs of a cartridge empty state in which the ink stored in the liquid chamber 210 of the cartridge 200 is used up (S22). Specifically, the controller 130 displays a cartridge empty image which indicates the use-up of the ink stored in the liquid chamber 210 of the cartridge 200 or the exchange of the cartridge 200 on the display 28. For example, the informing of the cartridge empty state is executed until "OFF" is stored in the C_Empty flag of the EEPROM 51 in step S14. That is, the cartridge empty image is displayed on the display 28 until a new cartridge 200 is installed since the ink stored in the liquid chamber 210 of the cartridge 200 is used up.

After execution of the process of step S22, the controller 130 determines whether the image data on the next page is stored in the RAM 52 (S23). When it is determined that the image data on the next page is stored in the RAM 52 (S23: Yes), the controller 130 executes the process of step S11 again. When it is determined that the image data on the next page is not stored in the RAM 52 (S23: No), the controller 130 ends the printing process.

When it is determined in the process of step S11 that the value of the S_Empty flag of the EEPROM 51 is "OFF" (S11: OFF), the controller 130 executes the processes of steps S15 to S18 again. When it is determined that all the liquid level signals obtained in steps S15 and S17 are "H" (S18: H→H), the controller 130 executes the fourth updating process (S21). In step S18, when the controller 130 determines that all the liquid level signals obtained in steps S15 and S17 are "H", the ink stored in the liquid chamber 171 of the tank 160 is in the following state. That is, the position of the liquid level of the ink stored in the liquid chamber 171 of the tank 160 before execution (S16) of the printing is lower than the reference position P (the liquid level signal obtained in step S15 is "H"). Further, the position of the liquid level of the ink is stored in the liquid chamber 171 of the tank 160 after execution (S16) of the printing is lower than the reference position P (the liquid level signal obtained in step S17 is "H"). That is, immediately after execution (S16) of the printing, the ink is not present in the liquid chamber 210 of the cartridge 200.

(Fourth Updating Process)

Figure 8D:
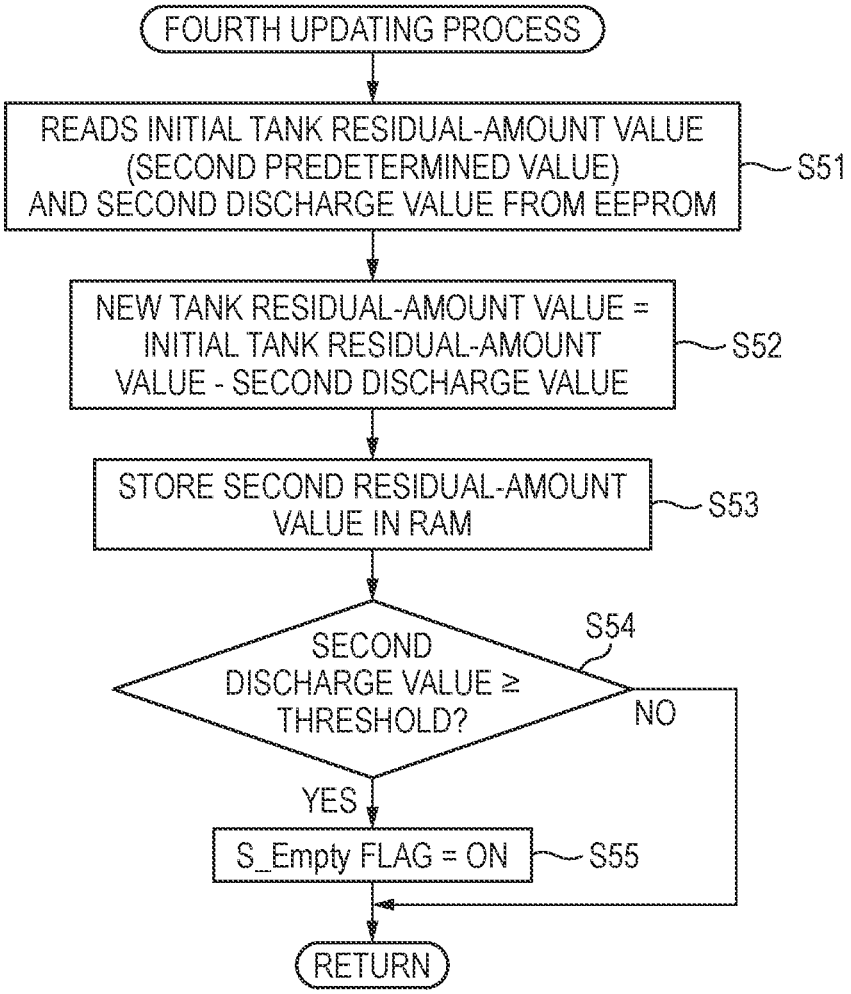
FIG. 8D is a flowchart of a fourth updating process.

The fourth updating process illustrated in FIG. 8D is a process that the controller 130 calculates the tank residual-amount value, and determines whether the printing is prohibited. First, the controller 130 reads the initial tank residual-amount value updated as the second predetermined value and the second discharge value from the EEPROM 51 (S51). The controller 130 subtracts the second discharge value from the read initial tank residual-amount value to calculate the new tank residual-amount value (S52). For example, similarly to the first discharge value, the second discharge value is a value obtained by multiplying the amount of one droplet of the ink discharged to the head 21 by the number of discharging the one droplet of the ink. The controller 130 instructs the head 21 to discharge the ink to count the second discharge value corresponding to the instruction. After the liquid level signal obtained from the liquid level sensor 33 is changed from "L" to "H", the controller 130 counts the second discharge value which indicates the amount of the ink which is discharged through the head 21 until the present time. That is, the second discharge value is an integration value of the amount of the ink which the head 21 discharges until the present time since the liquid level signal obtained from the liquid level sensor 33 is changed from "L" to "H". The second discharge value is stored in the EEPROM 51.

The controller 130 stores the calculated new tank residual-amount value in the RAM 52 (S53). Next, the controller 130 determines whether the counted second discharge value reaches a threshold (S54). The threshold is a value which is stored in the ROM 37 or the EEPROM 51 in advance. When it is determined that the counted second discharge value does not reach the threshold (S54: No), the controller 130 ends the fourth updating process. On the other hand, when it is determined that the counted second discharge value reaches the threshold (S54: Yes), the controller 130 stores "ON" in the S_Empty flag of the EEPROM 51 (S55), and ends the fourth updating process. Although the flowchart is not illustrated, when it is determined that "ON" is stored in the S_Empty flag of the EEPROM 51, the controller 130 prohibits the discharging of the ink through the head 21 including the printing and the maintenance.

The threshold is such a value that the liquid level of the ink stored in the liquid chamber 171 of the tank 160 is positioned slightly above the outflow port 174 when the second discharge value reaches the threshold. Specifically, in some cases, errors occur between the reference position P which the liquid level sensor 33 is designed to detect and the reference position P which the liquid level sensor 33 actually detects. For example, the errors occur due to faults of the operation of the actuator 190. The threshold is such a value that the liquid level of the ink stored in the liquid chamber 171 of the tank 160 is not overlapped with the outflow port 174 when the second discharge value reaches the threshold although the errors are the maximum errors which can be assumed at the time of designing. The controller 130 prohibits the discharge of the ink through the head 21 to prevent the air from entering the head 21. In addition to the above-described errors, the threshold may be such a value that the liquid level of the ink stored in the liquid chamber 171 of the tank 160 is not overlapped with the outflow port 174 when the second discharge value reaches the threshold although the printer 10 is placed on the surface of a predetermined inclination angle in consideration that the printer 10 is placed on the inclined surface. In addition, the second discharge value may include errors similarly to the first discharge value in some cases. The threshold may be such a value that the liquid level of the ink stored in the liquid chamber 171 of the tank 160 is not overlapped with the outflow port 174 when the second discharge value reaches the threshold although the errors in the second discharge value are the maximum.

The controller 130 executes the first updating process, the second updating process, the third updating process, and the fourth updating process illustrated in FIGS. 8A to 8D regarding each of the inks having colors such as black, magenta, cyan, and yellow.

As illustrated in FIG. 7, when the fourth updating process (S21) ends, the controller 130 determines whether the next page is stored in the RAM 52 (S23). When it is determined that the next page is stored in the RAM 52 (S23: Yes), the controller 130 executes the process of step S11 again. When it is determined that the next page is not stored in the RAM 52 (S23: No), the controller 130 ends the printing process.

As described above, whenever the printing of step S16 is executed, the controller 130 determines the cartridge residual-amount value and the tank residual-amount value based on the amount of the ink used to print. In the above description, an example of determining the cartridge residual-amount value and the tank residual-amount value whenever the controller 130 executes the printing of one page has been described. However, instead of this method, the controller 130 may determine the cartridge residual-amount value and the tank residual-amount value every time of executing printing of one pass. In addition, the controller 130 executes the second updating process, the third updating process, and the fourth updating process at the time of discharging the ink through the head 21 for the maintenance or the like as well as at the time of printing. The executing instruction of the maintenance is one example of the discharge instruction.

A management-information transmitting process that the printer 10 generates management information and transmits the information to the information collection server 40 will be described with reference to FIGS. 9A and 9B. The controller 130 of the printer 10 determines whether the date/time information output by the clock 30 is a predetermined transmission time stored in the EEPROM 51 (S61). When it is determined that the date/time information output by the clock 30 is not the predetermined transmission time (S61: No), the controller 130 ends the management-information transmitting process.

When it is determined that the date/time information output by the clock 30 is the predetermined transmission time (S61: Yes), the controller 130 reads the value of the C_Empty flag from the EEPROM 51 and determines whether the read value of the C_Empty flag is "ON" (S62). That is, in step S62, the controller 130 determines whether the ink stored in the liquid chamber 210 of the cartridge 200 installed in the installation case 150 is used up.

When it is determined that the value of the C_Empty flag of the EEPROM 51 is "OFF" (S62: No), the controller 130 reads the initial cartridge residual-amount value, the initial tank residual-amount value, and the initial filling value from the EEPROM 51 (S63). The controller 130 reads the identification information of the cartridge 200 from the memory of the IC chip 34 of the cartridge 200, and reads the initial filling value corresponding to the read identification information from the EEPROM 51. For example, when the read identification information indicates a large volume of black cartridge, the initial filling value corresponding to the large volume of black cartridge is read. In addition, for example, when the read identification information indicates a small volume of color cartridge, the initial filling value corresponding to the small volume of color cartridge is read.

The controller 130 reads the first discharge value from the EEPROM 51 (S64). The controller 130 calculates the total residual amount value by subtracting the read first discharge value from the value obtained by adding the read initial cartridge residual-amount value and the read initial tank residual-amount value (S65). The total residual amount value is one example of a total amount Vt.

Similarly to the above-described second updating process, the controller 130 determines the new cartridge residual-amount value and the new tank residual-amount value from the calculated total residual amount value (S66). The controller 130 stores the determined new cartridge residual-amount value in the RAM 52 and the memory of the IC chip 34 (S67). In addition, the controller 130 stores the determined new tank residual-amount value in the RAM 52 (S68). The cartridge residual-amount value determined in step S66 is one example of the amount of the liquid in the first liquid chamber. The tank residual-amount value determined in step S66 is one example of the amount of the liquid in the second liquid chamber.

The controller 130 calculates a total residual amount ratio by dividing the calculated total residual amount value by the read initial filling value (S69). The initial filling value is one example of the total amount Vt0.

The controller 130 determines whether the calculated total residual amount ratio exceeds "1". A case where the total residual amount ratio exceeds "1" will be described in detail.

In a state where the ink remains in the liquid chamber 171 of the tank 160, when a new cartridge 200 storing the initial filling amount of ink is installed in the installation case 150, the total residual amount exceeds the initial filling amount. That is, the total residual amount value becomes a value which exceeds the initial filling value. When the total residual amount value is a value which exceeds the initial filling value, the total residual amount ratio calculated by dividing the total residual amount value by the initial filling value exceeds "1". That is, when the new cartridge 200 storing the initial filling amount of ink is installed in the installation case 150 in a state where the ink remains in the liquid chamber 171 of the tank 160, the total residual amount ratio exceeds "1".

When it is determined that the calculated total residual amount ratio exceeds "1" (S70: Yes), the controller 130 changes the calculated total residual amount ratio to "1" (S71). On the other hand, when it is determined that the calculated total residual amount ratio does not exceed "1" (S71: No), the controller 130 skips the process of step S71.

The information collection server 40 can be also connected with a printer which does not transmit the total residual amount ratio exceeding "1". When the ratio exceeds "1", the total residual amount ratio is changed to "1" so as to achieve the consistency with the printer which does not transmit the total residual amount ratio exceeding "1". The printer which does not transmit the total residual amount ratio exceeding "1" means a printer which does not include the tank 160 and includes only the cartridge 200. The printer which does not include the tank 160 and includes only a cartridge transmits the value obtained by dividing the present residual amount by the initial filling amount of the cartridge as a residual amount ratio. That is, the printer which does not include the tank 160 and includes only a cartridge transmits the residual amount ratio which is equal to or less than "1". The printer 10 changes the total residual amount ratio exceeding "1" to "1", so as to achieve the consistency with the printer which does not the tank 160 and includes only a cartridge. That is, also with respect to the information collection server 40 which cannot process the residual amount value exceeding "1", the printer 10 can transmit the total residual amount ratio to perform the process on the information collection server 40.

On the other hand, when it is determined that the value of the C_Empty flag of the EEPROM 51 is "ON" (S62: Yes), the controller 130 reads the cartridge residual-amount value which is the first predetermined value (zero) from the memory of the IC chip 34 and reads the tank residual-amount value which is the second predetermined value, and the initial filling value from the EEPROM 51 (S72). The controller 130 reads the initial filling value from the EEPROM 51 in step S72 similarly to step S63. In addition, the controller 130 reads the second discharge value from the EEPROM 51 (S73). The controller 130 calculates a new tank residual-amount value by subtracting the read second discharge value from the read tank residual-amount value (S74). The controller 130 stores the calculated new tank residual-amount value in the RAM 52 (S75). The tank residual amount calculated in step S74 is one example of the liquid amount in the second liquid chamber and the total amount Vt.

The controller 130 calculates the total residual amount value by adding the calculated new tank residual-amount value and the cartridge residual-amount value (=first predetermined value=0) read in step S72 (S76). The controller 130 calculates the total residual amount ratio by dividing the calculated total residual amount value by the initial filling value read in step S72 (S77). The total residual amount value is one example of the total amount Vt. The total residual amount ratio is one example of total amount information.

The controller 130 stores the total residual amount ratio calculated in step S69, the total residual amount ratio changed to "1" in step S71, or the total residual amount ratio calculated in step S77 in the RAM 52 (S78).

Next, the controller 130 reads the value of the C_Empty flag, the cartridge residual-amount value, the tank residual-amount value, the total residual amount ratio, the device information, the identification information of the cartridge 200 (S79). In step S79, the controller 130 reads the value of the C_Empty flag and the device information from the EEPROM 51 and reads the identification information from the memory of the IC chip 34. Further, in step S79, the controller 130 reads the total residual amount ratio which has already been stored in the RAM 52 in step S78. In addition, the cartridge residual-amount value stored in the RAM 52 in step 75 is read in step S79, and the tank residual-amount value stored in the RAM 52 in step 75 is read in step S72.

The controller 130 generates management information which includes the read value of the C_Empty flag, the cartridge residual-amount value, the tank residual-amount value, the total residual amount ratio, the model name and the identification information of the printer 10 indicated by the device information, the identification information of the cartridge 200, and the cartridge installation flag (S80). In addition, the controller 130 transmits the generated management information to the information collection server 40 (S81). After transmitting the management information, the controller 130 stores "OFF" in the cartridge installation flag of the EEPROM 51, and ends the management-information transmitting process.

The management information is generated on each of the inks having colors such as black, magenta, cyan, and yellow, and is transmitted.

As described above, the management information is transmitted when it is a transmission time. For example, the transmission time is 0 o'clock, 12 o'clock, or the like. That is, the management information is made at an appointed time (first predetermined time) everyday. Therefore, the management information is made at intervals of 24 hours. The "intervals of 24 hours" are one example of a predetermined time interval. The controller 130 may transmit the management information at other time intervals such as two days (intervals of 48 hours).

(Ordering Process)

The management information which the printer 10 transmits is received by the information collection server 40. The information collection server 40 receiving the management information executes an ordering process. The ordering process which is executed by the information collection server 40 receiving the management information will be described with reference to FIG. 10A. The controller 45 of the information collection server regularly executes the ordering process illustrated in FIG. 10A. Specifically, the controller 45 executes the ordering process when the date/time information output by the clock 48 becomes a predetermined time stored in the storage part 42. For example, the predetermined time is a time such as five minutes, ten minutes, or one hour. The controller 45 executes the ordering process every predetermined time. The controller 45 may execute the ordering process in a time period including the time when the printer 10 transmits contact information.

When the ordering process starts, first, the controller 45 of the information collection server 40 determines whether the management information is received (S91). When it is determined that the management information is not received (S91: No), the controller 45 ends the ordering process. On the other hand, when it is determined that the management information is received (S91: Yes), the controller 45 determines whether the value of the cartridge installation flag included in the management information is "ON". That is, in step S92, it is determined whether the cartridge 200 is installed in the printer 10.

When it is determined that the value of the cartridge installation flag is "ON" (S92: Yes), the controller 45 stores "OFF" in an ordering flag stored in the storage part 42 (S93). The ordering flag is a flag for preventing the duplicated order of the cartridge 200. The detail description will be given below. On the other hand, when it is determined that the value of the cartridge installation flag is "ON" (S92: No), the controller 45 skips the process of step S93.

Next, the controller 45 determines whether the value of the C_Empty flag included in the received management information is "ON" (S94). That is, in step S94, the controller 130 determines whether the ink stored in the cartridge 200 is used up. When it is determined that the value of the C_Empty flag is "ON" (S94: Yes), the controller 45 executes an ordering-date/time determining process (S95).

The ordering-date/time determining process (S95) is a process that the information collection server 40 determines the ordering date/time when the information collection server 40 orders the cartridge 200 based on the received management information. The ordering-date/time determining process will be described with reference to FIGS. 10B and 11.

The controller 45 determines whether the printer which transmits the management information is a printer-with-a-tank which has the tank 160 based on the device information included in the received management information (S101). The printer which is not the printer-with-a-tank means a printer which includes only an installation case and does not include the tank 160. That is, the printer which is not the printer-with-a-tank is a printer which does not transmit the total residual amount ratio exceeding "1" as described above.

When it is determined that the printer 10 which transmits the management information including the device information is not the printer-with-a-tank (S101: No), the controller 45 ends the ordering-date/time determining process. On the other hand, when it is determined that the printer 10 which transmits the management information including the device information is the printer-with-a-tank (S101: Yes), the controller 45 reads a reference ratio based on the identification information of the cartridge 200 included in the management information (S102). The reference ratio is a total residual amount ratio immediately after the ink stored in the liquid chamber 210 of the cartridge 200 is used up. A table which indicates a correlation between the identification information of the cartridge 200 and the reference ratio is stored in the storage part 42 in advance. For example, the storage part 42 stores the reference ratio in which the identification information corresponds to the small-volume cartridge, and the reference ratio in which the identification information corresponds to the large-volume cartridge. Further, the storage part 42 stores the reference ratio in which the identification information corresponds to, for example, colors (cyan, magenta, and yellow), and the reference ratio in which the identification information corresponds to, for example, black. That is, the EEPROM 51 stores two kinds (the small-volume cartridge or the large-volume cartridge) of the reference ratios with respect to color and stores two kinds (the small-volume cartridge or the large-volume cartridge) of the reference ratios with respect to black.

The controller 45 reads the reference ratio corresponding to the identification information included in the management information from the storage part 42. For example, when the identification information included in the management information indicates a large-volume black cartridge, the reference ratio which corresponds to the large-volume black cartridge is read from the storage part 42. In addition, for example, when the identification information included in the management information indicates a small-volume color cartridge, the reference ratio which corresponds to the small-volume color cartridge is read from the storage part 42. The reference ratio may be included in the management information transmitted by the printer 10. In that case, for example, the storage part 42 may store each of the reference ratios in the EEPROM 51 as described above. Then, in step S80, the reference ratio corresponding to the identification information is read from the EEPROM 51, and the read reference ratio is included in the management information. Thereafter, in step S81, the printer 10 transmits the management information including the reference ratio to the information collection server 40. Further, the controller 45 obtains the reference ratio from the management information.

Next, the controller 45 causes the storage part 42 to store the obtained total residual amount ratio and the obtained reference ratio in correspondence to the acquisition date/time which is the date/time when the clock 48 outputs at the time of obtaining the management information as a record of a residual-amount management list (not illustrated) (S103). The residual-amount management list is created with respect to the cartridge 200 of each color of each of the printers 10. For example, the residual-amount management list is identified by an ID generated by an identification controller 45. Instead of the acquisition date/time, the controller 45 may store an acquisition date not including the time, the total residual amount ratio, and the reference ratio in correspondence to each other in the residual-amount management list.

The residual-amount management list includes a plurality of records. One record corresponds to a piece of received management information. That is, every time of receiving the management information, the controller 45 stores the received management information as the record in the residual-amount management list. The residual-amount management lists are created with respect to each cartridges 200 of each printer.

The residual-amount management list includes the record at each acquisition date/time and a plurality of items. The plurality of items include an "acquisition date/time", a "total residual amount ratio", a "cartridge residual-amount value", a "tank residual-amount value", an "exchange flag", "the number of times", and the like. The residual-amount management list may include other items in addition to the above-described items.

The item "acquisition date/time" is a date/time when the management information is obtained. The item "total residual amount ratio" is a total residual amount ratio included in the management information. The item "total residual amount" is a value which indicates the total residual amount of the ink stored in the liquid chamber 210 of the cartridge 200 of the printer 10 and the liquid chamber 171 of the tank 160. The total residual amount value may be included together with the total residual amount ratio in the management information, and the controller 45 may be calculated from the identification information, the total residual amount ratio, and the device information included in the management information. The item "cartridge residual-amount value" is a cartridge residual-amount value included in the management information. The item "tank residual-amount value" is a tank residual-amount value included in the management information. The item "ordering flag" is a value which indicates "ON" or "OFF" and is stored in the storage part 42. When a new cartridge 200 is ordered, "ON" is stored in the ordering flag of the storage part 42. When the cartridge 200 is installed in the printer 10, "OFF" is stored in the ordering flag of the storage part 42. The item "number of installation" is a value which indicates the number of installation the cartridge 200 in the printer 10 until the present time.

Next, the controller 45 counts the number of the records in which the total residual amount ratio is lower than "1" in each of the residual-amount management lists and determines whether the counted value is equal to or larger than 2 (S104). That is, in step S104, the controller 45 determines whether there are two or more records in which the total residual amount ratio is lower than "1" in each of the residual-amount management lists. The determination of the controller 45 is performed in the same way in each of the residual-amount management lists. Thus, hereinafter, one residual-amount management list will be described below.

When it is determined that the counted value is 1 or less (S104: No), the controller ends the process. On the other hand, when it is determined that the counted value is equal to or larger than 2 (S104: Yes), the controller 45 determines a linear function between the date/time and the total residual amount ratio (S105).

Figure 11:
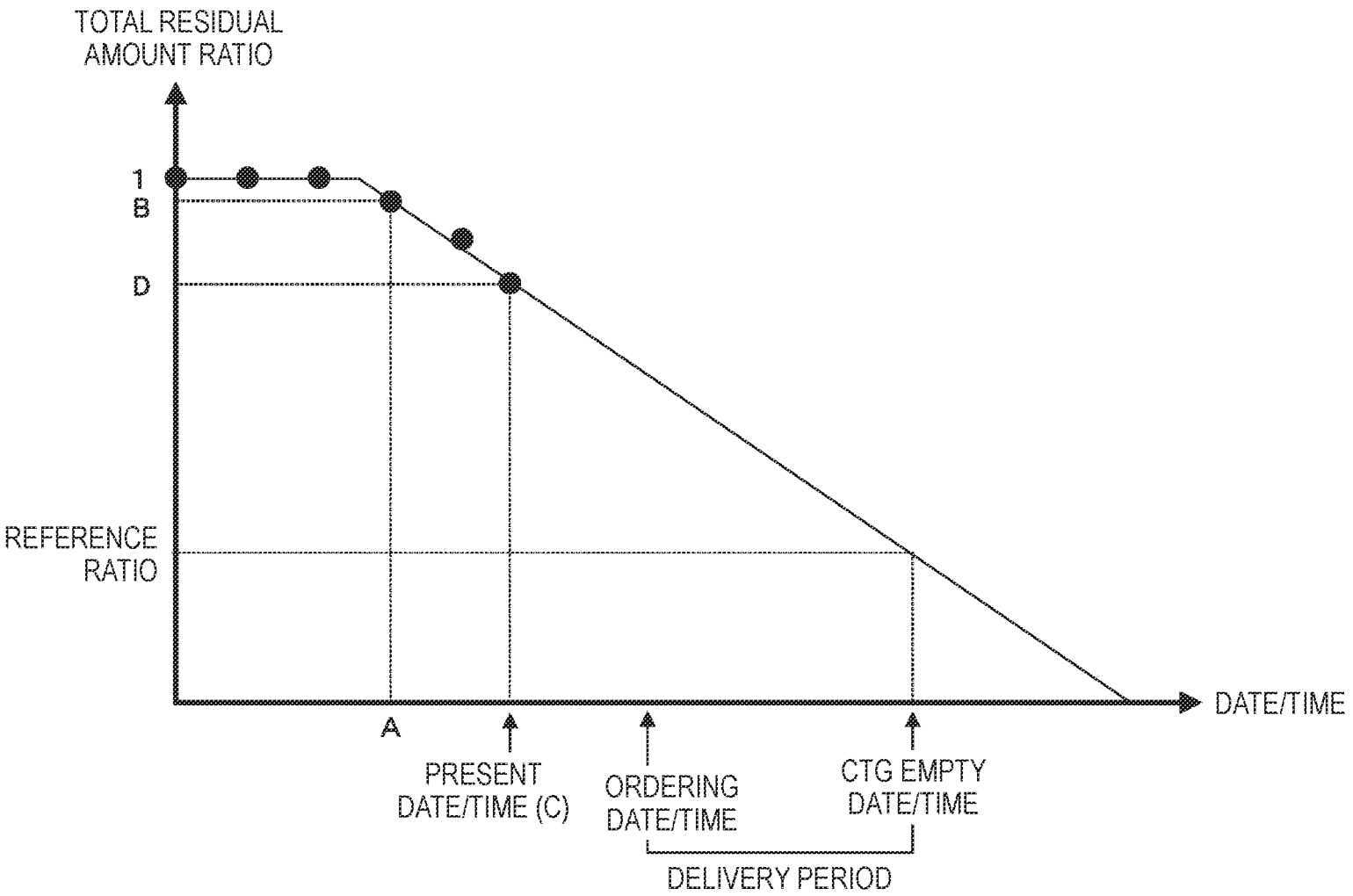
FIG. 11 is a diagram for explaining a linear function and an ordering date/time of the first exemplary embodiment.

In step S105, the linear function determined by the controller 45 is described in detail with reference to FIG. 11. In the drawing, a horizontal axis (x axis) indicates the date/time, and a vertical axis (y axis) indicates the total residual amount ratio.

The controller 45 determines an initial record in which the total residual amount ratio is lower than 1 based on the items "total residual amount ratio" and "acquisition date/time" of the residual-amount management list. The controller 45 obtains the acquisition date/time "A" and total residual amount ratio "B" of the determined record from the residual-amount management list. In addition, the controller 45 determines the newest record based on the item "acquisition date/time" of the residual-amount management list. The controller 45 obtains the acquisition date/time "C" and the total residual amount ratio "D" of the determined record from the residual-amount management list.

The controller 45 determines a straight line which passes through a point (A, B) or a point (C, D) with an inclination of (D-B)/(C-A) as a linear function. The controller 45 may determine a straight line which passes through points which indicate two arbitrary records in which the ratio is lower than 1 as a linear function.

Figure 10A:
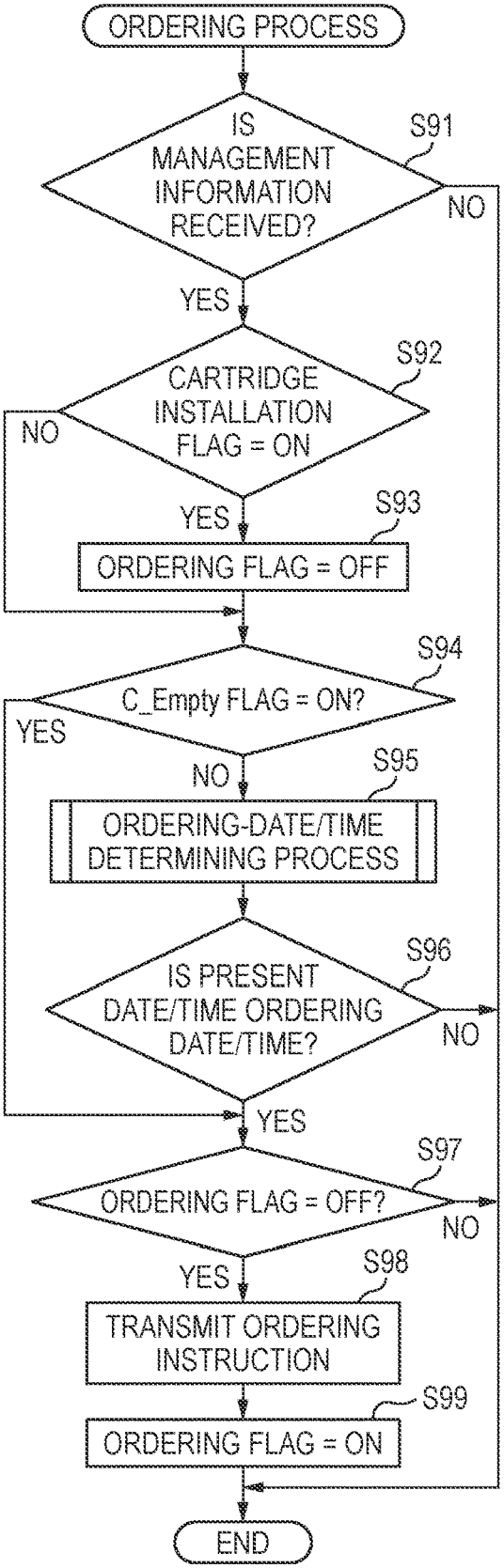
FIG. 10A is a flowchart of an ordering process.
Figure 10B:
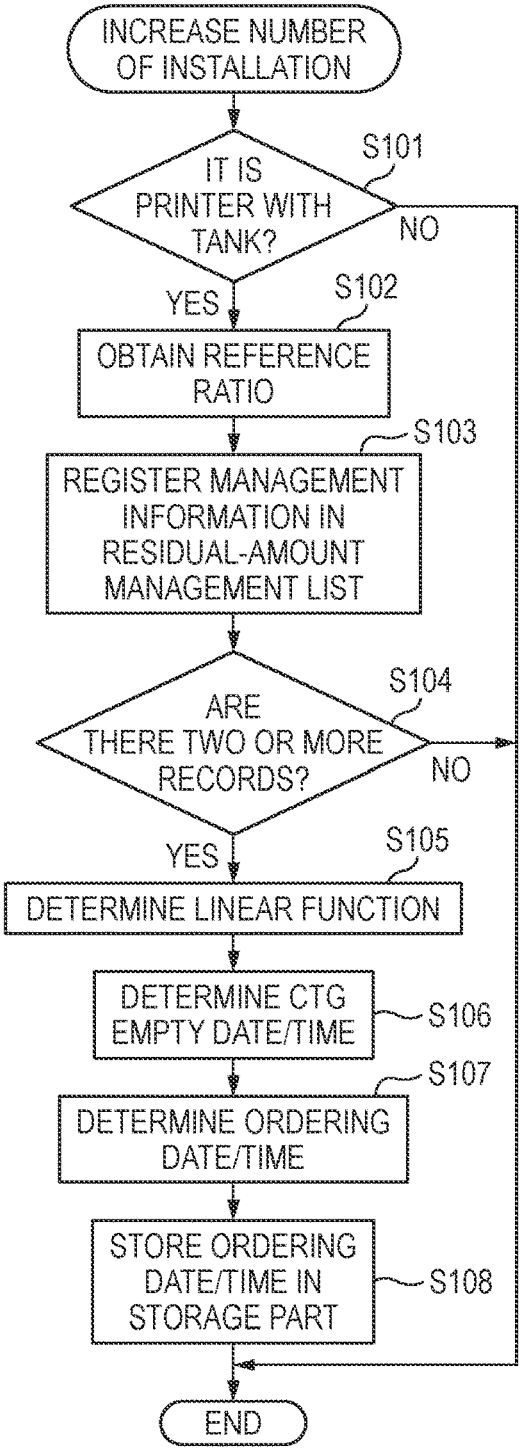
FIG. 10B is a flowchart of an ordering-date/time determining process.

As illustrated in FIG. 10B, the controller 45 determines a CTG empty date/time after determining the linear function (S106). "CTG" means "cartridge". The controller 45 determines the ordering date/time which is the date/time when the cartridge 200 is ordered from the determined CTG empty date/time (S107). The controller 45 causes the storage part 42 to store the determined ordering date/time (S108), and ends the ordering-date/time determining process. The determination of the CTG empty date/time and the ordering date/time is described in detail with reference to FIG. 11.

In step S106, the controller 45 determines the CTG empty date/time which is the date/time when the total residual amount ratio becomes the reference ratio based on the determined linear function. That is, the date/time when the ink stored in the liquid chamber 210 of the cartridge 200 is assumed to be used up is determined as the CTG empty date/time. In step S107, the controller 45 determines the date/time, which is prior to the determined CTG empty date/time by a delivery period, as the ordering date/time of the cartridge 200. Then, the controller 45 registers the determined ordering date/time in a cartridge management list. The delivery period is the shortest time required for the delivery of the ordered cartridge 200 and is stored in the storage part 42 in advance. The delivery period is one example of the predetermined time. The ordering date/time is one example of the predetermined date/time.

The cartridge management list includes a plurality of records. In one record, various items are stored with respect to one cartridge 200. The items are the identification information of the cartridge 200, the device information of the printer, the ordering date/time, and the value of the newest C_Empty flag. The value of the newest C_Empty flag means the value of the C_Empty flag which is stored in the newest record of the residual-amount management list.

As illustrated in FIG. 10A, the controller 45 determining the ordering date/time determines whether the present date/time is the ordering date/time determined in step S95 (S96). When it is determined that the present date/time is not the ordering date/time (S96: No), the controller 45 ends the ordering process. On the other hand, when it is determined that the present date/time is the ordering date/time (S96: Yes), the controller 45 determines whether the value of the ordering flag of the storage part 42 is "OFF" (S97). That is, in step S97, the controller 45 determines whether the new cartridge 200 is already ordered.

When it is determined that the value of the ordering flag of the storage part 42 is not "OFF", that is, is "ON" (S97: No), the controller 45 ends the ordering process. That is, when the new cartridge 200 is already ordered, the cartridge 200 is not ordered again, and the ordering process ends. On the other hand, when it is determined that the value of the ordering flag of the storage part 42 is "OFF" (S97: Yes), the controller 45 transmits an ordering instruction to the ordering server 50 (S98). Specifically, at the appointed time such as 10 o'clock or 12 o'clock every day, the controller 45 determines whether there is a record (cartridge 200) which is the ordering date/time. Then, the controller 45 transmits the ordering instruction on the cartridge 200 which is determined to be the ordering date/time to the ordering server 50. The ordering instruction includes information (identification information) such as a model number which specifies the type of the cartridge 200 and a destination (that is, address information) to which the cartridge 200 is delivered. The ordering server 50 receiving the ordering instruction arranges to send the cartridge 200 which indicates the model number (identification information) included in the ordering instruction to the destination included in the ordering instruction.

On the other hand, when it is determined that the value of the C_Empty flag included in the management information is "ON" (S94: No), the controller 45 skips the processes of steps S95 and S96 and executes the processes of steps S97 and S98. That is, when the ink stored in the liquid chamber 210 of the cartridge 200 is used up, the new cartridge 200 is ordered immediately without determining the ordering date/time. In that case, the controller 45 makes the ordering instruction include designation information which designates the delivery speed such as "express". In addition, the controller 45 may transmit the ordering instruction at earlier time without waiting until the predetermined time such as 12 o'clock.

After the transmission of the ordering instruction, the controller 45 increases the value of the item "number of installation" (S99) and ends the ordering process.

On the other hand, although not illustrated in the drawing, the ordering server 50 determines whether the ordering instruction is received. When it is determined that the ordering instruction is received, the ordering server 50 generates sending information. The sending information is information which indicates to send the cartridge 200 indicated by the identification information included in the ordering instruction to the addressee and the address indicated by the destination information included in the ordering instruction. When the designation information is included in the received ordering instruction, the ordering server 50 generates the sending information such that the cartridge 200 is sent in the type (express) of the delivery designated by the designation information. The generated sending information is used for the sending operation of the cartridge 200.

The new cartridge 200 sent at the ordering date/time arrives at the destination of the user after the CTG empty date/time. That is, the above-described delivery period stored in the storage part 42 is the shortest time required for the delivery of the cartridge 200, and thus the cartridge 200 sent at the ordering date/time arrives at the destination of the user after the CTG empty date/time.

In this exemplary embodiment, the controller 130 of the printer 10 transmits the residual-amount information including the total residual amount ratio of the ink stored in the liquid chamber 210 of the cartridge 200 and the liquid chamber 171 of the tank 160 to the information collection server 40.

In this exemplary embodiment, the total residual amount ratio which the printer 10 transmits is equal to or less than 1. The information collection server 40 can similarly handle the residual amount ratio input from the conventional printer not having the tank 160 and the total residual amount ratio input from the printer 10 having the tank 160. As a result, separate information collection servers may not be used at every type of the printer, and one information collection server 40 can place both the order of the cartridge with respect to the printer not having the tank 160, and the order of the cartridge 200 with respect to the printer 10 having the tank 160.

In this exemplary embodiment, the liquid level sensor 33 detects that the ink stored in the liquid chamber 210 of the cartridge 200 is used up. The total residual amount value calculated from the discharging value of the ink discharged through the head 21 includes errors as described above. Therefore, compared to a case where it is determined from the total residual amount value that the ink stored in the liquid chamber 210 of the cartridge 200 is used up, it is possible to accurately detect that the ink stored in the liquid chamber 210 of the cartridge 200 is used up.

In this exemplary embodiment, the residual-amount information is transmitted to the information collection server 40 at the appointed time everyday. Thus, compared to a case where the residual-amount information is transmitted at each time of printing, it is possible to reduce the communication amount between the printer 10 and the information collection server 40.

In this exemplary embodiment, the reference position P which is a position where the signal of the liquid level sensor 33 is changed from "L" to "H" has the same height as the axial center of the needle 181 in the up and down direction 7 and has the same height as the center of the ink supply port 234. Therefore, when the ink stored in the liquid chamber 210 of the cartridge 200 is used up, the signal output by the liquid level sensor 33 is changed from "L" to "H". That is, liquid level information indicating the signal output by the liquid level sensor 33 indicates whether the liquid stored in (the liquid chamber of) the cartridge is used up. Therefore, the information collecting server 40 can determine whether the liquid stored in (the liquid chamber of) the cartridge is used up.

In this exemplary embodiment, the new cartridge 200 arrives at the destination of the user after the CTG empty date/time. Therefore, a concern that the cartridge 200 with the ink remained is exchanged with the new cartridge 200 is reduced. That is, a concern that the ink is discarded wastefully is reduced.

Second Exemplary Embodiment

In the first exemplary embodiment described above, an example in which the residual-amount information including the total residual amount ratio is transmitted from the printer 10 to the information collection server 40 has been described. In a second exemplary embodiment, an example in which management information including a cartridge residual amount ratio and a tank residual amount ratio is transmitted from the printer 10 to the information collecting device 40 will be described. Processes other than the process which will be described below are the same as those of the above-described first exemplary embodiment.

Figure 9A:
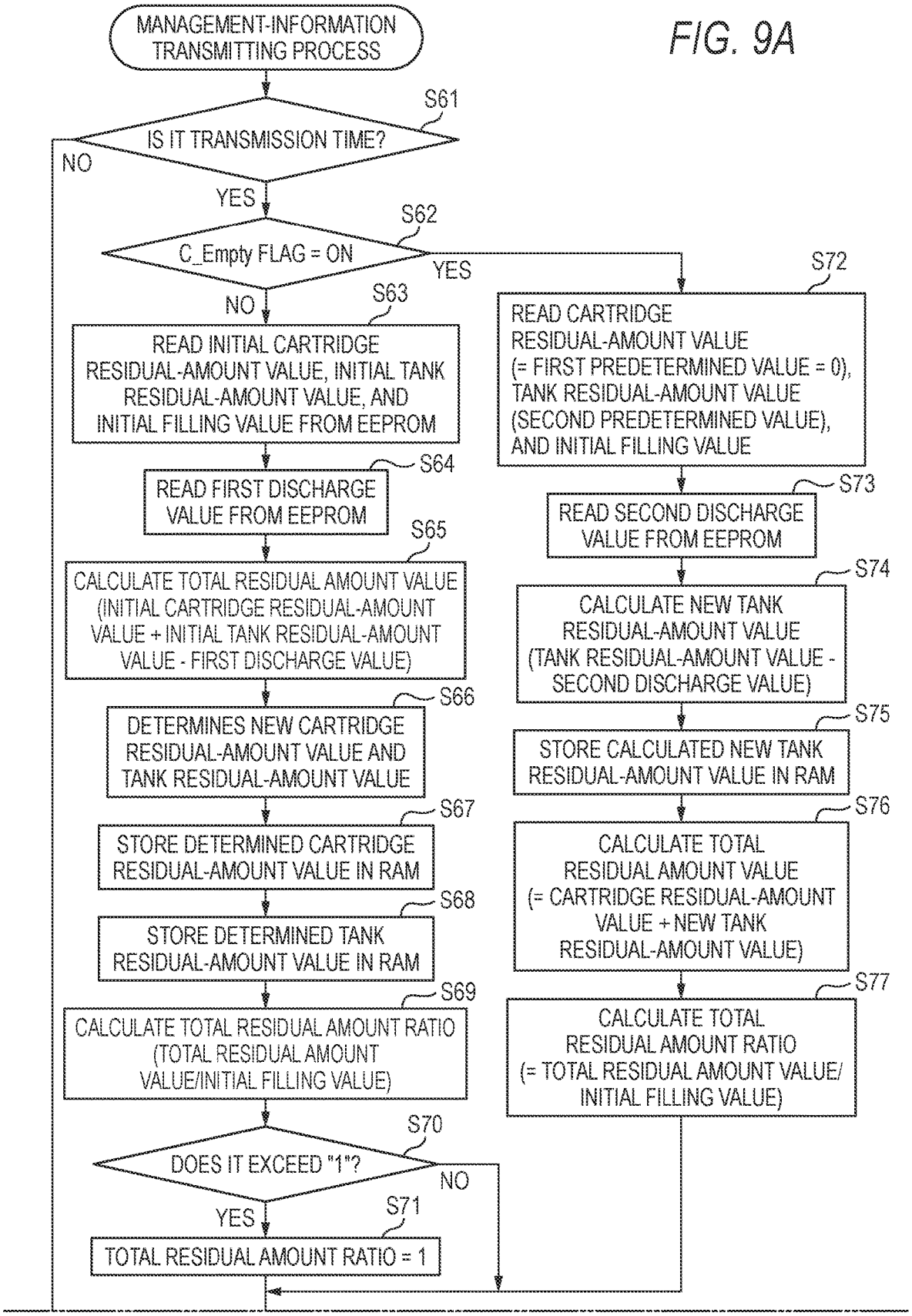
FIGS. 9A and 9B illustrate a flowchart of a management-information transmitting process of a first exemplary embodiment.
Figure 9B:
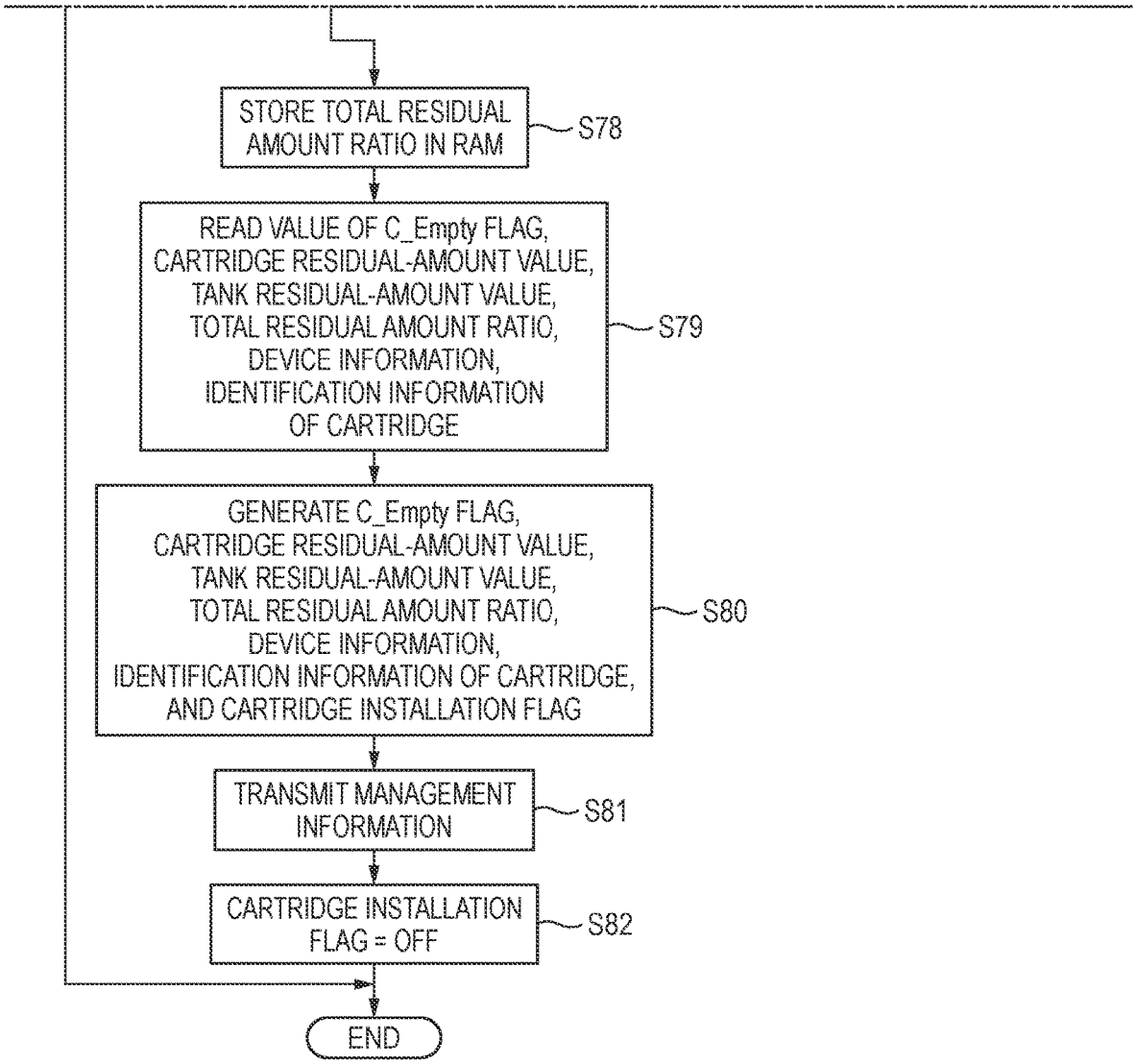
Figure 12A:
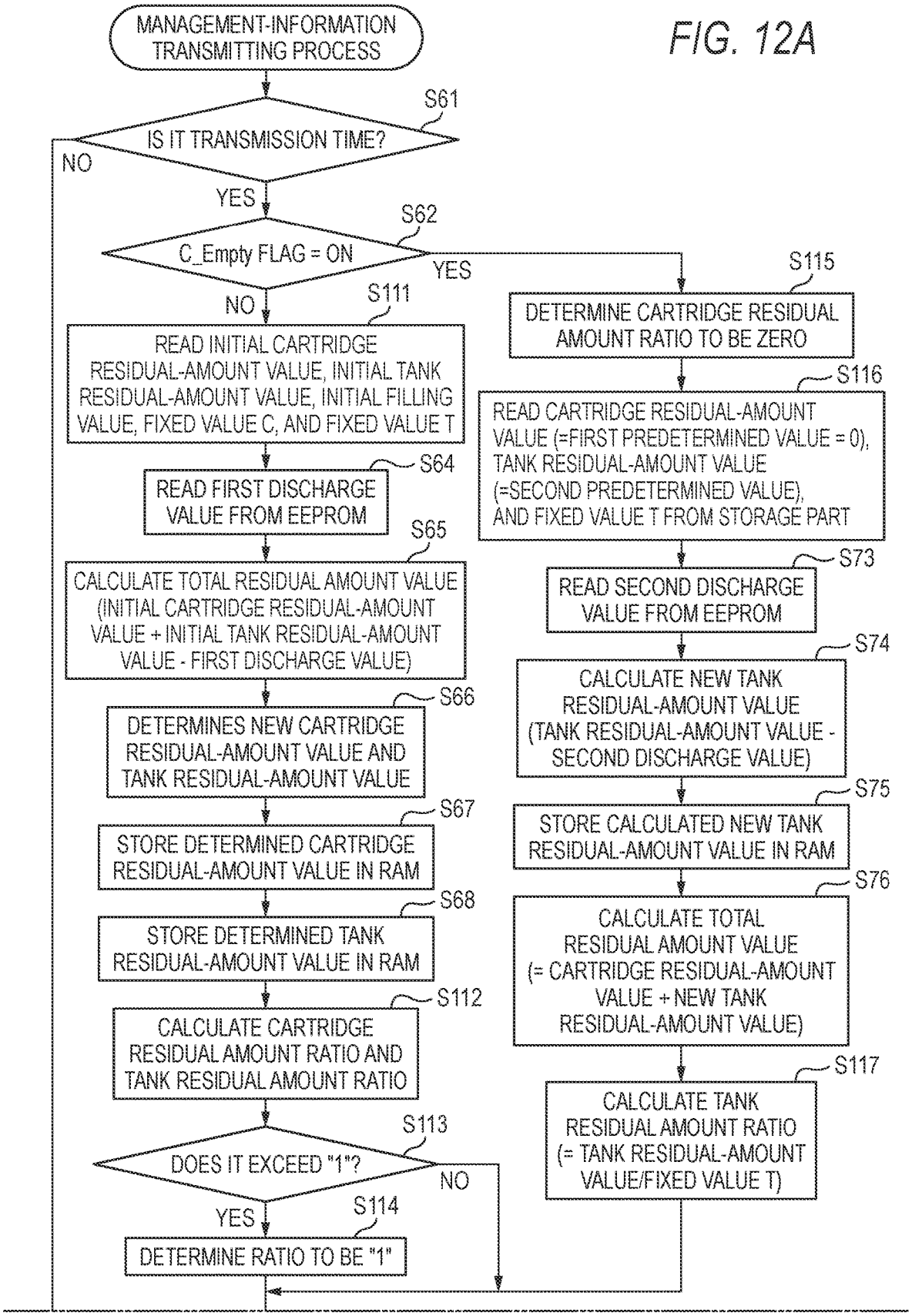
FIGS. 12A and 12B illustrate a flowchart of a management-information transmitting process of a second exemplary embodiment.
Figure 12B:
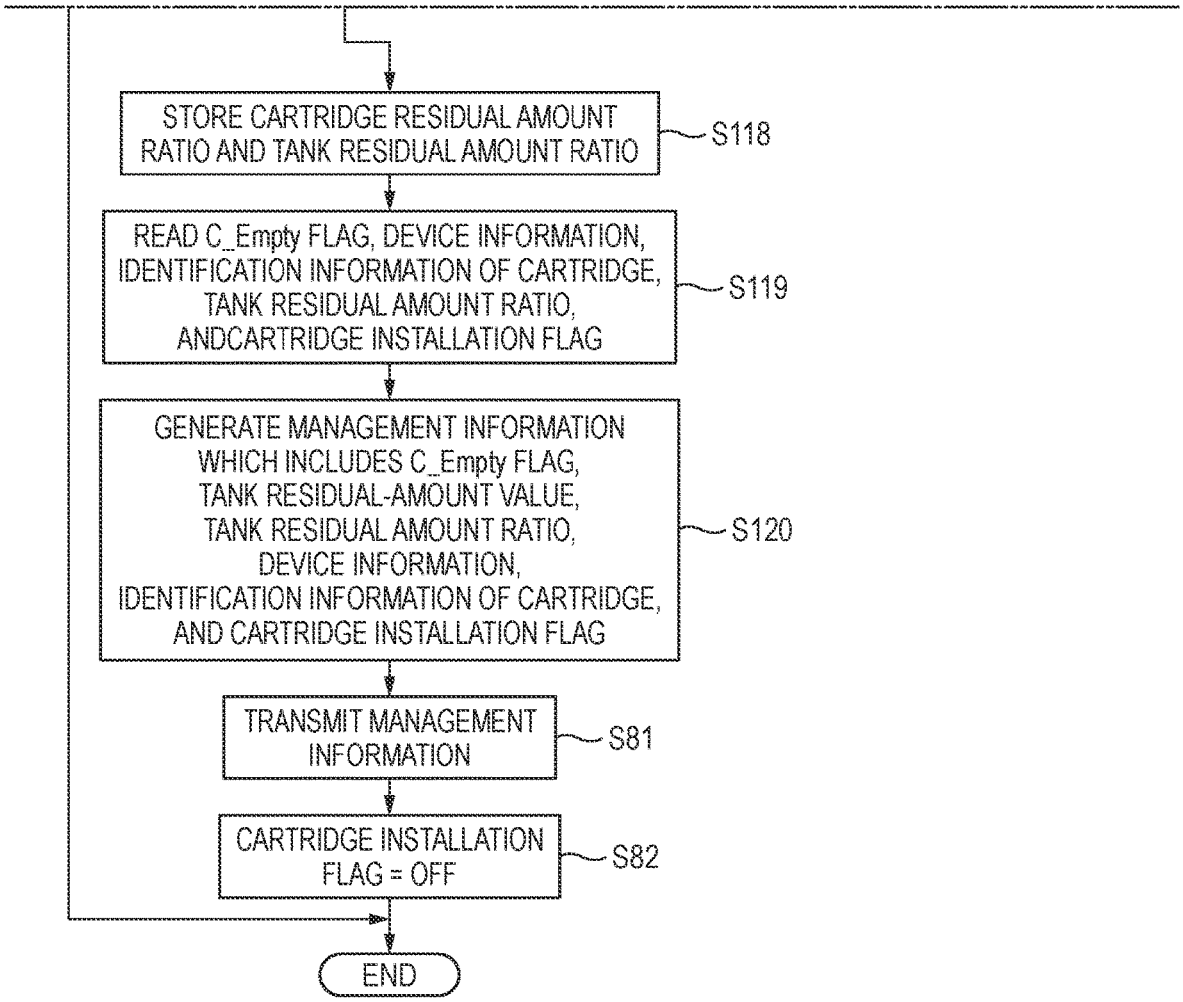

The controller 130 of the printer 10 of the second exemplary embodiment executes a management-information transmitting process illustrated in FIGS. 12A and 12B instead of the management-information transmitting process illustrated in FIGS. 9A and 9B. Hereinafter, the same process as the management-information transmitting process which has been described in the above-described first exemplary embodiment is denoted by the same reference numerals, and the description thereof will be omitted.

First, similarly to the first exemplary embodiment, the controller 130 executes the processes of steps S61 and S62. In step S62, when it is determined that the value of the C_Empty flag of the EEPROM 51 is "OFF" (S62: No), the controller 130 reads the initial cartridge residual-amount value, the initial tank residual-amount value, the initial filling value, a fixed value C, and a fixed value T from the EEPROM 51 (S111). The controller 130 reads the identification information of the cartridge 200 from the memory of the IC chip 34 of the cartridge 200 and reads the fixed value C corresponding to the read identification information from the EEPROM 51.

In the second exemplary embodiment, the EEPROM 51 of the printer 10 stores the fixed value C corresponding to the identification information which is stored in the memory of the IC chip 34 of the cartridge 200. The fixed value C is a value which indicates the amount of the ink which is stored in the liquid chamber 210 of the cartridge 200 when the cartridge 200 which stores the initial filling amount of ink is installed in the installation case 150 in a state where the S_Empty flag of the EEPROM 51 is "ON". Specifically, the fixed value C is a value which indicates the amount of the ink which is stored in the liquid chamber 210 of the cartridge 200 when there is almost no difference between the water head of the ink which is stored in the liquid chamber 210 of the cartridge 200 and the water head of the ink which is stored in the liquid chamber 171 of the tank 160. The fixed value C is one example of the liquid amount Vc0.

For example, the EEPROM 51 stores the fixed value C in which the identification information corresponds to the small-volume cartridge and the fixed value C in which the identification information corresponds to the large-volume cartridge. Further, the EEPROM 51 stores the fixed value C in which the identification information corresponds to, for example, colors (cyan, magenta, and yellow) and the fixed value C in which the identification information corresponds to, for example, black. That is, the EEPROM 51 stores two kinds (the small-volume cartridge or the large-volume cartridge) of the fixed values C with respect to color, and stores two kinds (the small-volume cartridge or the large-volume cartridge) of the fixed value C with respect to black.

The fixed value C is the same value as the initial cartridge residual-amount value (step S34 of FIG. 8A) which is calculated when the cartridge 200 which stores the initial filling amount of ink is installed in the installation case 150 in a state where the S_Empty flag of the EEPROM 51 is "ON".

In step S111, for example, when the read identification information indicates the large-volume black cartridge, the controller 130 reads the fixed value C which corresponds to the large-volume black cartridge. In addition, for example, when the read identification information indicates the small-volume color cartridge, the controller 130 reads the fixed value C which corresponds to the small-volume color cartridge.

The fixed value T is a value which indicates the amount of the ink until the S_Empty flag of the EEPROM 51 is "ON" since the C_Empty flag of the EEPROM 51 is "ON". The fixed value T is one example of the liquid amount Vs0.

For example, the EEPROM 51 stores the fixed value T in which the identification information corresponds to, for example, color (cyan, magenta, and yellow) and the fixed value T in which the identification information corresponds to, for example, black. That is, the EEPROM 51 stores two kinds (color or black) of fixed values T.

In step S111, for example, when the read identification information indicates black, the controller 130 reads the fixed value T corresponding to the black. In addition, for example, when the read identification information indicates color, the controller 130 reads the fixed value T corresponding to the color.

Next, similarly to the first exemplary embodiment, the controller 130 executes the processes of steps S64 to S68. The cartridge residual-amount value determined in step S66 is one example of the liquid amount Vc in the first liquid chamber. The tank residual-amount value determined in step S66 is one example of the liquid amount Vs in the second liquid chamber.

Next, the controller 130 calculates the cartridge residual amount ratio and the tank residual amount ratio (S112). Specifically, the controller 130 calculates the cartridge residual amount ratio by dividing the cartridge residual-amount value determined in step S66 by the fixed value C read in step S111. In addition, the controller 130 calculates the tank residual amount ratio by dividing the tank residual-amount value determined in step S66 and the fixed value T read in step S111. The cartridge residual amount ratio is one example of a cartridge ratio and cartridge information. The tank residual amount ratio is one example of the tank residual amount ratio and tank information.

The controller 130 determines whether the calculated cartridge residual amount ratio and the calculated tank residual amount ratio exceed "1" (S113). A case where the cartridge residual amount ratio exceeds "1" will be described in detail.

The fixed value C is a value which indicates the amount of the ink which is stored in the liquid chamber 210 of the cartridge 200 when the cartridge 200 which stores the initial filling amount of ink is installed in the installation case 150 in a state where the S_Empty flag of the EEPROM 51 is "ON". Specifically, the fixed value C is a value which indicates the amount of the ink which is stored in the liquid chamber 210 of the cartridge 200 when there is almost no difference between the water head of the ink which is stored in the liquid chamber 210 of the cartridge 200 and the water head of the ink which is stored in the tank 160. Therefore, when the new cartridge 200 which stores the initial filling amount of ink is installed in the installation case 150 in a state where the ink remains in the liquid chamber 171 of the tank 160, the cartridge residual-amount value becomes a value exceeding the fixed value C. When the cartridge residual-amount value is a value exceeding the fixed value C, the cartridge residual amount ratio calculated by dividing the cartridge residual-amount value by the fixed value C exceeds "1". That is, when the new cartridge 200 which stores the initial filling amount of ink is installed in the installation case 150 in a state where the ink remains in the liquid chamber 171 of the tank 160, the cartridge residual amount ratio exceeds "1".

The fixed value T is a value which indicates the amount of the ink until the S_Empty flag of the EEPROM 51 is "ON" since the C_Empty flag of the EEPROM 51 is "ON". Therefore, the tank residual-amount value is a value which exceeds the fixed value T until the C_Empty flag of the EEPROM 51 is "ON". When the tank residual-amount value is a value exceeding the fixed value T, the tank residual amount ratio calculated by dividing the tank residual-amount value by the fixed value T exceeds "1". That is, the tank residual amount ratio exceeds "1" until the C_Empty flag of the EEPROM 51 is "ON".

When it is determined that the calculated cartridge residual amount ratio exceeds "1" (S113: Yes), the controller 130 determines the calculated cartridge residual amount ratio as "1" (S114). In addition, when it is determined that the calculated tank residual amount ratio exceeds "1" (S113: Yes), the controller 130 determines the calculated tank residual amount ratio as "1" (S114).

On the other hand, when it is determined that the calculated cartridge residual amount ratio does not exceed "1" (S113: No), the controller 130 skips the process of step S114 of determining the cartridge residual amount ratio as "1". In addition, when it is determined that the calculated tank residual amount ratio does not exceed "1" (S113: No), the controller 130 skips the process of step S114 of determining the tank residual amount ratio as "1".

The information collection server 40 can be connected with the printer which does not transmit the cartridge residual amount ratio exceeding "1". The cartridge residual amount ratio and the tank residual amount ratio which exceed "1" are changed to "1" so as to achieve the consistency with the printer which does not transmit the cartridge residual amount ratio exceeding "1". The printer which does not transmit the cartridge residual amount ratio exceeding "1" means a printer which does not include the tank 160 and includes only a cartridge. The printer which does not include the tank 160 and includes only a cartridge transmits the value obtained by dividing the present residual amount by the initial filling amount of the cartridge as a residual amount ratio. That is, the printer which does not include the tank 160 and includes only a cartridge transmits the cartridge residual amount ratio which is equal to or less than "1". The printer 10 changes the cartridge residual amount ratio exceeding "1" to "1", thereby achieving the consistency with the printer which does not the tank 160 and includes only a cartridge. That is, also with respect to the information collection server 40 which cannot process the cartridge residual amount ratio exceeding "1", the printer 10 can transmits the cartridge residual amount ratio and the tank residual amount ratio to perform the process on the information collection server 40.

On the other hand, when it is determined that in step S62, the value of the C_Empty flag of the EEPROM 51 is "ON" (S62: Yes), the controller 130 determines the cartridge residual amount ratio as zero (S115). That is, when the ink stored in the liquid chamber 210 of the cartridge 200 is used up, it is determined that the cartridge residual amount ratio is zero. The cartridge residual amount ratio which is determined to be zero in step S62 is one example of the cartridge ratio.

Next, the controller 130 reads the cartridge residual-amount value which is the first predetermined value (zero) from the memory of the IC chip 34, and reads the tank residual-amount value which is the second predetermined value and the fixed value T from the EEPROM 51 (S116). The controller 130 reads the fixed value T from the EEPROM 51 in step S116 similarly to step S111. Next, similarly to the first exemplary embodiment, the controller 130 executes the processes of steps S73 to S76. The tank residual-amount value calculated in step S74 is one example of the liquid amount Vs.

The controller 130 calculates the tank residual amount ratio by dividing the tank residual-amount value calculated in step S74 by the fixed value T read in step S116 (S117). The calculated tank residual amount ratio is one example of the tank ratio.

The controller 130 stores the cartridge residual amount ratio and the tank residual amount ratio which are calculated in step S112, the cartridge residual amount ratio and the tank residual amount ratio which are determined to be "1" in step S114, or the cartridge residual amount ratio which is determined to be "zero" in step S115 and the tank residual amount ratio calculated in step S117 in the RAM 52 (S118).

Next, the controller 130 reads the value of the C_Empty flag, the device information, the identification information of the cartridge, the cartridge residual amount ratio, the tank residual amount ratio, and the value of the cartridge installation flag from the RAM 52 or the EEPROM 51 (S119). In step S119, the controller 130 reads the value of the C_Empty flag, the device information, and the value of the cartridge installation flag from the EEPROM 51 and reads the identification information of the cartridge from the memory of the IC chip 34. Further, in step S119, the controller 130 reads the cartridge residual amount ratio and the tank residual amount ratio which have already stored in the RAM 52 in step S118.

The controller 130 generates the management information which includes the read value of the C_Empty flag, the device information, the identification information of the cartridge 200, the cartridge residual amount ratio, the tank residual amount ratio, and the value of the cartridge installation flag (S120). Similarly to the first exemplary embodiment, the controller 130 transmits the generated management information to the information collection server 40 through the communication I/F 31 (S81). In addition, similarly to the first exemplary embodiment, the controller 130 stores "OFF" in the cartridge installation flag of the EEPROM 51 (S82), and ends the management-information transmitting process. Similarly to the first exemplary embodiment, the management information transmitted by the information collection server 40 is received in the information collection server 40.

In this exemplary embodiment, by transmitting the management information including the cartridge residual amount ratio and the tank residual amount ratio, the ordering date/time can be determined in the information collection server 40, and the new cartridge 200 can be ordered in the information collection server 40.

First Modification

In the first exemplary embodiment and the second exemplary embodiment described above, an example in which the management information including the value of the C_Empty flag which is the information indicating the signal output by the liquid level sensor 33 is transmitted from the printer 10 to the information collection server 40 has been described. However, the value of the C_Empty flag may be transmitted separately from the management information. Hereinafter, the description will be given in detail.

When it is determined in step S12 (FIG. 7) that the cartridge 200 is installed in the installation case 150 (S12: Yes), the controller 130 of the printer 10 stores the date/time information output by the clock 30 as installation date/time information in the EEPROM 51. That is, the installation date/time information indicates the date/time when the cartridge 200 is installed. The installation date/time information is one example of the predetermined time.

Figure 13:
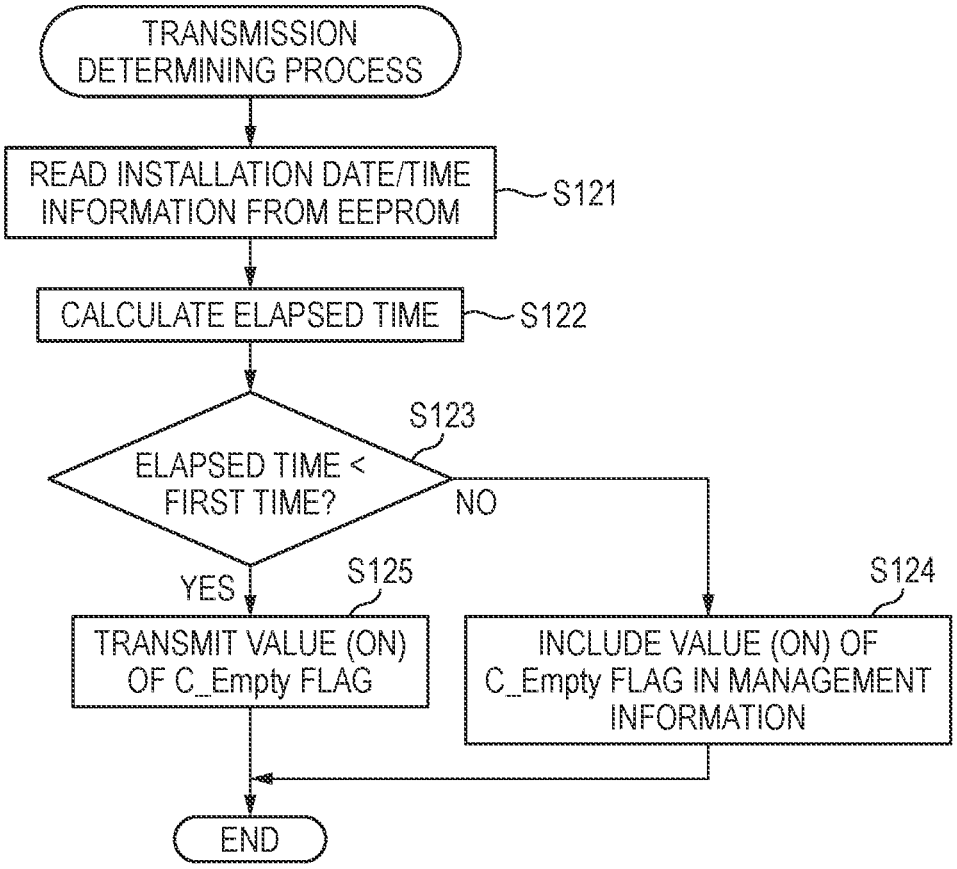
FIG. 13 is a flowchart of a transmission determining process of a first modification.

When "ON" is stored in the C_Empty flag of the EEPROM 51 in step S49 (FIG. 8C), the controller 130 executes a transmission determining process illustrated in FIG. 13. First, the controller 130 reads the installation date/time information from the EEPROM 51 (S121). Next, the controller 130 calculates an elapsed time until the date/time information (present date/time) output by the clock 30 from the read installation date/time information (S122).

The controller 130 determines whether the calculated elapsed time is shorter than the first time stored in the EEPROM 51 (S123). When it is determined that the calculated elapsed time is equal to or longer than the first time (S123: No), the controller 130 determines that the value (ON) of the C_Empty flag of the EEPROM 51 is included in the management information (S124), and ends the transmission determining process. Similarly to the first exemplary embodiment and the second exemplary embodiment, when it is the predetermined transmission time stored in the EEPROM 51, the management information including the value of the C_Empty flag is transmitted from the printer 10 to the information collection server 40 (FIG. 9A: S61).

On the other hand, when it is determined that the calculated elapsed time is shorter than the first time (S123: Yes), the controller 130 transmits the value (ON) of the C_Empty flag to the information collection server 40 without waiting the predetermined transmission time stored in the EEPROM 51 (S125), and ends the transmission determining process.

The calculated elapsed time indicates a time until the ink stored in the liquid chamber 210 of the cartridge 200 is used up since the cartridge 200 is installed. The fact that the calculated elapsed time is shorter than the first time means that the discharge rate of the ink stored in the liquid chamber 210 of the cartridge 200 is high. In this modification, when the discharge rate of the ink stored in the liquid chamber 210 of the cartridge 200 is low, the value (ON) of the C_Empty flag is included in the management information which is transmitted at the predetermined transmission time stored in the EEPROM 51 and is transmitted to the information collection server 40. Therefore, compared to a case where the value (ON) of the C_Empty flag is transmitted separately from the management information, the number of times of communicating between the printer 10 and the information collection server 40 is reduced.

On the other hand, when the discharge rate of the ink stored in the liquid chamber 210 of the cartridge 200 is high, the value (ON) of the C_Empty flag is transmitted without waiting the predetermined transmission time stored in the EEPROM 51. Therefore, compared to a case where the value (ON) of the C_Empty flag is included in the management information to be transmitted with waiting the predetermined transmission time stored in the EEPROM 51, it can be determined without delay in the information collection server 40 that the ink stored in the liquid chamber 210 of the cartridge 200 is used up.

The value (ON) of the C_Empty flag may be transmitted in step S125 immediately after calculating the elapsed time or may be transmitted at another different time from the predetermined transmission time of transmitting the management information. For example, the controller 130 transmits the management information at 0 o'clock everyday and transmits the value (ON) of the C_Empty flag at the predetermined time such as 9 o'clock, 12 o'clock, 15 o'clock, or 18 o'clock.

Second Modification

In the first exemplary embodiment described above, an example in which the controller 45 determines the ordering date/time from the CTG empty date/time has been described. In the second modification, the controller 45 determines the CTG empty date/time and an ink empty date/time from the determined linear function. Then, in this modification, the description will be given about an example in which the controller 45 determines the estimated arrival date from the determined CTG empty date/time and the determined ink empty date/time and determines the ordering date/time from the determined estimated arrival date/time. The ink empty indicates when the ink of the liquid chamber 171 of the tank 160 is used up. At that time, as described above, the liquid level of the ink stored in the liquid chamber 171 of the tank 160 is located slightly above the outflow port 174.

Figure 14:
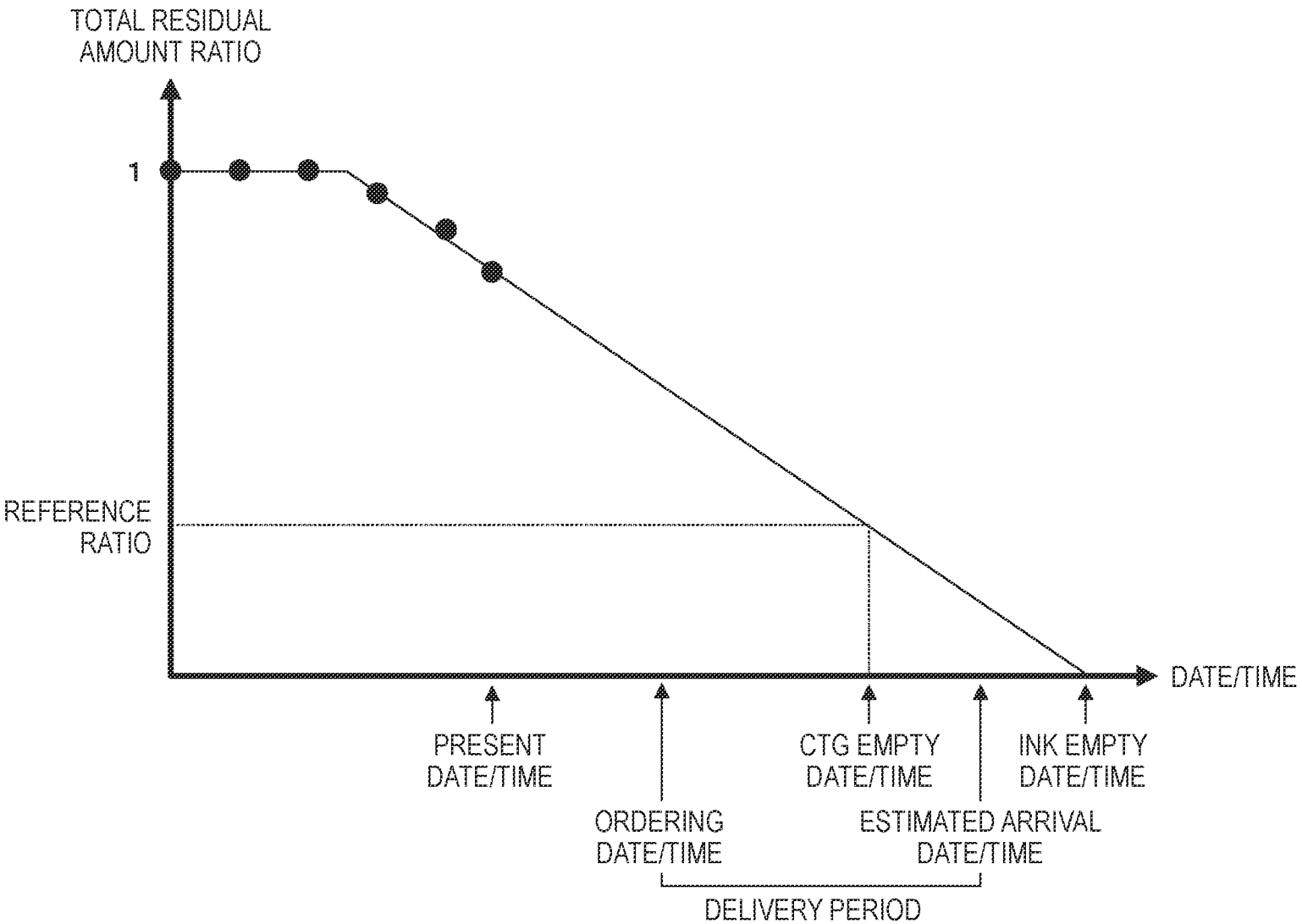
FIG. 14 is a diagram for explaining a linear function and an ordering date/time of a second modification.

Similarly to the first exemplary embodiment, the controller 45 of the information collection server 40 determines the linear function (S105 of FIG. 10B) and determines the CTG empty date/time from the determined linear function (S106). In addition, the controller 45 determines the ink empty date/time illustrated in FIG. 14. Specifically, in the determined linear function, the date/time when the total residual amount ratio becomes zero is determined as the ink empty date/time. The CTG empty date/time is one example of a first date/time. The ink empty date/time is one example of a second date/time.

The controller 45 determines the date/time between the determined CTG empty date/time and the determined ink empty date/time as the estimated arrival date/time when the cartridge 200 is to be delivered to the destination of the user. The controller 45 determines the date/time which is prior to the determined estimated arrival date/time by the delivery period, as the ordering date/time. The controller 45 stores the determined ordering date/time as the item "ordering date/time" of the cartridge management list in the storage part 42. When it is determined that the present date/time is the ordering date/time (S96), the controller 45 transmits the ordering instruction to the ordering server 50 (S98). The delivery period is one example of the predetermined time. The ordering date/time is one example of the predetermined date/time.

The controller 45 may determine the central date/time between the CTG empty date/time and the ink empty date/time among the date/time between the determined CTG empty date/time and the determined ink empty date/time as the estimated arrival date/time when the cartridge 200 is to be delivered to the destination of the user.

It is determined that the middle date/time between the CTG empty date/time and the ink empty date/time are the estimated arrival date/time when the cartridge 200 is to be delivered to the destination of the user. Thus, a possibility is reduced that the ordered new cartridge is delivered to the destination of the user at the date time later than the ink empty date/time although the delivery of the new cartridge 200 is delayed, and a possibility is reduced that the ordered new cartridge is delivered to the destination of the user at the date time earlier than the CTG empty date/time although the delivery of the new cartridge 200 is early. Therefore, a concern that the cartridge 200 with ink remained is exchanged with the new cartridge 200 and the ink is discarded wastefully is reduced. In addition, a concern that the ink of the printer 10 is used up so that the printing fails to continue until the new cartridge 200 is delivered is reduced.

Other Modification

In the first exemplary embodiment described above, an example in which the management information including the total residual amount ratio is transmitted from the printer 10 to the information collection server 40 has been described. However, together with the total residual amount ratio or instead of the total residual amount ratio, the controller 130 of the printer 10 may transmit the total residual amount value calculated in the updating process illustrated in FIGS. 8A to 8D with being included in the management information.

In the above-described second exemplary embodiment, an example in which the management information including the cartridge residual amount ratio and the tank residual amount ratio is transmitted from the printer 10 to the information collection server 40 has been described. However, together with the cartridge residual amount ratio and the tank residual amount ratio, or instead of the cartridge residual amount ratio and the tank residual amount ratio, the controller 130 of the printer 10 may transmit the cartridge residual-amount value and the tank residual-amount value which are calculated in the updating process illustrated in FIGS. 8A to 8D with being included in the management information.

In the first exemplary embodiment and the second exemplary embodiment described above, an example in which the value of the C_Empty flag of the EEPROM 51 is transmitted together with the total residual amount ratio from the printer 10 to the information collection server 40 has been described. However, the value of the C_Empty flag may be transmitted separately from the total residual amount ratio. For example, the value of the C_Empty flag may be transmitted at the appointed time such as 9 o'clock, 12 o'clock, 15 o'clock, or 18 o'clock everyday. In addition, the value of the C_Empty flag which is "ON" may be transmitted immediately. Specifically, in step S55 (FIGS. 8A to 8D), when "ON" is stored in the value of the C_Empty flag of the EEPROM 51, the controller 130 of the printer 10 immediately transmits the value of the C_Empty flag which is "ON" through the communication I/F 31 to the information collection server 40.

In the first exemplary embodiment and the second exemplary embodiment described above, an example in which the management information is transmitted from the printer 10 to the information collection server 40 at the appointed time everyday has been described. However, the total residual amount ratio may be transmitted from the printer 10 to the information collection server 40 at each time of printing or at each time of discharging the ink through the head 21 for the maintenance or the like. Otherwise, the management information may be transmitted from the printer 10 to the information collection server 40 under the condition that request information demanding the transmission of the management information from the information collection server 40 to the printer 10 is transmitted. Instead of the process of step S61 (FIG. 9A), the controller 130 of the printer 10 executes the process to determine whether the request information is input from the information collection server 40.

In the above-described first modification, the installation date/time information which indicates the date/time when the cartridge 200 is installed is described as one example of a predetermined time. However, various time such as a time when the printing is executed for the first time after the cartridge 200 is installed, a time when the ink is discharged through the head 21 for the first time after the cartridge 200 is installed, and a time when the ink is discharged through the head 21 by a predetermined amount after the cartridge 200 is installed may be set as the predetermined time.

In the first exemplary embodiment or the second exemplary embodiment described above, a configuration that the controller 130 detects whether the detection target portion 194 of the actuator 190 is in a first state or in a second state based on the signal output by the liquid level sensor 33 has been described. However, the configuration of the liquid level sensor 33 is not particularly limited thereto as long as the liquid level of the ink in the liquid chamber 171 can be detected. For example, the liquid level sensor 33 may be a sensor which optically detects the liquid level of the ink in the liquid chamber 171 by using a prism having a reflectivity which is different depending on whether the ink contacts the rear wall 164 of the liquid chamber 171. In addition, the liquid level sensor 33 may be an electrode rod which is inserted into the liquid chamber 171.

In the first exemplary embodiment or the second exemplary embodiment described above, the ink has been described as one example of the liquid. However, for example, a pretreatment liquid which is discharged on a paper and the like prior to ink at the time of printing may be stored in the cartridge. In addition, water for cleaning the head 21 may be stored in the cartridge.

As discussed above, the disclosure may provide at least the following illustrative, non-limiting embodiments.

(1) A liquid consuming device comprising: an installation case configured to receive a cartridge, the cartridge comprising a first liquid chamber storing a liquid; a tank comprising a second liquid chamber; a flow path configured to communicate with the second liquid chamber and the first liquid chamber of the cartridge installed in the installation case; a head communicated with the second liquid chamber; a first communication interface; and a first controller configured to: determine a total amount Vt of a first liquid amount and a second liquid amount, the first liquid amount being liquid amount in the first liquid chamber that is installed in the installation case to communicate with the second liquid chamber through the flow path, the second liquid amount being liquid amount in the second liquid chamber that communicates with the first liquid chamber of the cartridge installed in the installation case through the flow path; and transmit, through the first communication interface that is connected to an external device, total amount information, the total amount information indicating the determined total amount Vt.

(2) The liquid consuming device of (1), wherein the first controller is configured to: determine a total amount Vt0, the total amount Vt0 being a total amount of: a liquid amount in the first liquid chamber in a state where a liquid does not move in the second liquid chamber and the first liquid chamber; and a liquid amount in the second liquid chamber in a state where a liquid does not move in the second liquid chamber and the first liquid chamber; calculate a ratio of the total amount Vt to the total amount Vt0; and transmit, through the first communication interface, the total amount information as being said ratio.

(3) The liquid consuming device of (2), wherein the first controller is configured to: determine whether the calculated ratio exceeds 1; and in a case it is determined that the calculated ratio exceeds 1, transmit, through the first communication interface, the total amount information of 1.

(4) The liquid consuming device of any one of (1) to (3), wherein the first controller is configured to: determine the total amount Vt at every predetermined time interval; and based on determining the total amount Vt at the every predetermined time interval, transmit, through the first communication interface, the total amount information indicating the total amount Vt determined at the every predetermined time interval.

(5) The liquid consuming device of any one of (1) to (4), further comprising: a liquid level sensor, wherein the first controller is configured to: receive, from the liquid level sensor, a signal in a case the position of a liquid level in the second liquid chamber of the tank is lower than a predetermined position; and transmit, through the first communication interface, liquid level information, the liquid level information corresponding to the received signal.

(6) The liquid consuming device of (5), wherein the first controller is configured to: measure an elapsed time until receiving the signal from a predetermined time point; determine whether the measured elapsed time is shorter than a first time; and in a case it is determined that the measured elapsed time is shorter than the first time, transmit, through the first communication interface, the liquid level information at a different time from the time of transmitting the total amount information.

(7) The liquid consuming device of (6), wherein the first controller is configured to, in response to that it is determined that the signal is received from the liquid level sensor and the measured elapsed time is shorter than the first time, transmit, through the first communication interface, the liquid level information.

(8) The liquid consuming device of (6) or (7), wherein the first controller is configured to, in a case it is determined that the measured elapsed time is equal to or longer than the first time, transmit, through the first communication interface, the liquid level information at the same time as the time of transmitting the total amount information.

(9) The liquid consuming device of any one of (1) to (4), further comprising: a liquid level sensor, wherein the first controller is configured to: receive, from the liquid level sensor, a signal in a case the position of a liquid level in the second liquid chamber of the tank is lower than a predetermined position; and transmit, through the first communication interface, liquid level information at a different time from the time of transmitting the total amount information, the liquid level information corresponding to the received signal.

(10) The liquid consuming device of (9), wherein the first controller is configured to, in response to receiving the signal from the liquid level sensor, transmit, through the first communication interface, the liquid level information.

(11) The liquid consuming device of any one of (5) to (10), wherein the first liquid chamber of the cartridge installed in the installation case communicates with the outside, wherein the second liquid chamber of the tank communicates with the outside, wherein a part of the second liquid chamber is located below the first liquid chamber of the cartridge installed in the installation case, and wherein the predetermined position is located below the first liquid chamber of the cartridge installed in the installation case.

(12) The liquid consuming device of any one of (1) to (11), wherein the first controller is configured to: receive a discharge instruction to discharge a liquid through the head; count a discharge amount of the liquid that is discharged from the head according to the received discharge instruction; and determine the total amount Vt of the first liquid amount and the second liquid amount after a liquid is discharged from the head according to the discharge instruction based on a counted value corresponding to the counted discharge amount of the liquid.

(13) The liquid consuming device of any one of (1) to (12), wherein the first controller is configured to: determine a liquid amount Vc and a liquid amount Vs, the liquid amount Vc being liquid amount in the first liquid chamber that is installed in the installation case and communicates with the second liquid chamber through the flow path, the liquid amount Vs being liquid amount in the second liquid chamber that communicates with the first liquid chamber of the cartridge installed in the installation case through the flow path from the determined total amount Vt; and transmit, through the first communication interface, the total amount information, cartridge information indicating the determined liquid amount Vc, and tank information indicating the determined liquid amount Vs.

(14) The liquid consuming device of any one of (1) to (13), comprising the cartridge.

(15) A liquid consuming system comprising: the liquid consuming device of any one of (1) to (14); and the external device comprising a second communication interface, a third communication interface, and a second controller configured to: receive the total amount information through the second communication interface connected to the first communication interface; determine a date/time when there is no liquid amount in the first liquid chamber of the cartridge installed in the installation case from the total amount Vt indicated by the received total amount information; determine a predetermined date/time, the predetermined date/time being prior to the determined date/time by a predetermined time; and in a case the determined predetermined date/time is reached, transmit, through the third communication interface, order information indicating to order the cartridge.

(16) A liquid consuming device comprising: an installation case configured to receive a cartridge, the cartridge comprising a first liquid chamber storing a liquid; a tank comprising a second liquid chamber; a flow path configured to communicate with the second liquid chamber and the first liquid chamber of the cartridge installed in the installation case; a head communicated with the second liquid chamber; a first communication interface; and a first controller configured to: determine a liquid amount Vc and a liquid amount Vs, the liquid amount Vc being liquid amount in the first liquid chamber that is installed in the installation case to communicate with the second liquid chamber through the flow path, the liquid amount Vs being liquid amount in the second liquid chamber that communicates with the first liquid chamber of the cartridge installed in the installation case through the flow path; and transmit, through the first communication interface that is connected to an external device, cartridge information, the cartridge information indicating the determined liquid amount Vc and tank information indicating the determined liquid amount Vs.

(17) The liquid consuming device of (16), wherein the first controller is configured to: determine a liquid amount Vc0 and a liquid amount Vs0, the liquid amount Vc0 being liquid amount in the first liquid chamber in a state where a liquid does not move in the second liquid chamber and the first liquid chamber, the liquid amount Vs0 being liquid amount in the second liquid chamber in a state where a liquid does not flow in from the first liquid chamber to the second liquid chamber; calculate a cartridge ratio of the liquid amount Vc to the liquid amount Vc0; calculate a tank ratio of the liquid amount Vs to the liquid amount Vs0; and transmit, through the first communication interface, the cartridge information as being the cartridge ratio and the tank information as being the tank ratio.

(18) The liquid consuming device of (17), wherein the first controller is configured to: determine whether the calculated cartridge ratio exceeds 1; and in a case it is determined that the calculated cartridge ratio exceeds 1, transmit, through the first communication interface, the cartridge information of 1.

(19) The liquid consuming device of (17) or (18), wherein the first controller is configured to: determine whether the calculated tank ratio exceeds 1; and in a case it is determined that the calculated tank ratio exceed 1, transmit, through the first communication interface, the tank information of 1.

(20) The liquid consuming device of any one of (16) to (19), wherein the first controller is configured to: determine the liquid amount Vc and the liquid amount Vs at every predetermined time interval; and based on determining the liquid amount Vc and the liquid amount Vs at the every predetermined time interval, transmit, through the first communication interface, the cartridge information indicating the determined liquid amount Vc and the tank information indicating the determined liquid amount Vs at the every predetermined time interval.

(21) The liquid consuming device of any one of (16) to (20), further comprising: a liquid level sensor, wherein the first controller is configured to: receive, from the liquid level sensor, a signal in a case the position of a liquid level in the second liquid chamber of the tank is lower than a predetermined position; and transmit, through the first communication interface, liquid level information, the liquid level information corresponding to the received signal.

(22) The liquid consuming device of (21), wherein the first controller is configured to: measure an elapsed time when the signal is received from a predetermined time point; determine whether the measured elapsed time is shorter than a first time; and in a case it is determined that the measured elapsed time is shorter than the first time, transmit, through the first communication interface, the liquid level information at a different time from the time of transmitting the cartridge information and the tank information.

(23) The liquid consuming device of (22), wherein the first controller is configured to, in response to that it is determined that the signal is received from the liquid level sensor and the measured elapsed time is shorter than the first time, transmit, through the first communication interface, the cartridge information and the tank information.

(24) The liquid consuming device of (22) or (23), wherein the first controller is configured to, in a case it is determined that the measured elapsed time is equal to or longer than the first time, transmit, through the first communication interface, the liquid level information at the same time as the time of transmitting the cartridge information and the tank information.

(25) The liquid consuming device of any one of (16) to (20), further comprising: a liquid level sensor, wherein the first controller is configured to: receive, from the liquid level sensor, a signal in a case the position of a liquid level in the second liquid chamber of the tank is lower than a predetermined position; and transmit, through the first communication interface, liquid level information at a different time from the time of transmitting the cartridge information and the tank information, the liquid level information corresponding to the received signal.

(26) The liquid consuming device of (25), wherein the first controller is configured to, in response to receiving the signal from the liquid level sensor, transmit, through the first communication interface, the cartridge information and the tank information.

(27) The liquid consuming device of any one of (21) to (26), wherein the first liquid chamber of the cartridge installed in the installation case communicates with the outside, wherein the second liquid chamber of the tank communicates with the outside, wherein a part of the second liquid chamber is located below the first liquid chamber of the cartridge installed in the installation case, and wherein the predetermined position is located below the first liquid chamber of the cartridge installed in the installation case.

(28) The liquid consuming device of any one of (16) to (27), wherein the first controller is configured to: receive a discharge instruction to discharge a liquid through the head; count a discharge amount of the liquid that is discharged from the head according to the received discharge instruction; and based on a counted value corresponding to the counted discharge amount of the liquid, determine a liquid amount Vc in the first liquid chamber and a liquid amount Vs in the second liquid chamber after a liquid is discharged from the head according to the discharge instruction.

(29) The liquid consuming device of any one of (16) to (28), wherein the first controller is configured to: determine a total amount Vt, the total amount Vt corresponding to a sum of the determined liquid amount Vc and the determined liquid amount Vs, and transmit, through the first communication interface, the cartridge information, the tank information, and total amount information indicating the determined total amount Vt.

(30) The liquid consuming device of any one of (16) to (29), comprising the cartridge.

(31) A liquid consuming system comprising: the liquid consuming device of any one of (16) to (30); and an external device comprising a second communication interface, a third communication interface, and a second controller configured to: receive the cartridge information and the tank information through the second communication interface that is connected to the first communication interface; from the liquid amount Vc indicated by the received cartridge information, determine a first date/time when there is no liquid in the first liquid chamber of the cartridge installed in the installation case; from the liquid amount Vc indicated by the received tank information, determine a second date/time when there is no liquid in the second liquid chamber of the tank; determine a predetermined date/time, the predetermined data/time being prior to an intermediate date/time by a predetermined time, the intermediate date/time being between the determined first date/time and the determined second date/time; and in a case the determined predetermined date/time is reached, transmit, through the third communication interface, order information indicating to order the cartridge.

A liquid consuming system according to the disclosure includes any one of the liquid consuming devices described above and an external device. The external device transmits order information based on information transmitted from the liquid consuming device.

What is claimed is:

1. A liquid consuming device comprising:

an installation case configured to receive a cartridge, the cartridge comprising a first liquid chamber storing a liquid;

a tank comprising a second liquid chamber;

a flow path configured to communicate with the second liquid chamber and the first liquid chamber of the cartridge installed in the installation case;

a head communicated with the second liquid chamber;

a first communication interface that is an external connection interface;

a liquid level sensor; and a first controller configured to:

determine a total amount Vt of a first liquid amount and a second liquid amount, the first liquid amount being liquid amount in the first liquid chamber that is installed in the installation case to communicate with the second liquid chamber through the flow path, the second liquid amount being liquid amount in the second liquid chamber that communicates with the first liquid chamber of the cartridge installed in the installation case through the flow path;

transmit, through the first communication interface that is connected to an external device, total amount information, the total amount information indicating the determined total amount Vt;

receive, from the liquid level sensor, a signal in a case the position of a liquid level in the second liquid chamber of the tank is lower than a predetermined position;

measure an elapsed time until receiving the signal from a predetermined time point;

determine whether the measured elapsed time is shorter than a first time; and transmit, through the first communication interface, liquid level information, the liquid level information corresponding to the received signal, wherein, in a case it is determined that the measured elapsed time is shorter than the first time, the liquid level information is transmitted through the first communication interface at a different time from the time of transmitting the total amount information.

2. The liquid consuming device according to claim 1, wherein the first controller is configured to:

determine a total amount Vt0, the total amount Vt0 being a total amount of: a liquid amount in the first liquid chamber in a state where a liquid does not move in the second liquid chamber and the first liquid chamber; and a liquid amount in the second liquid chamber in a state where a liquid does not move in the second liquid chamber and the first liquid chamber;

calculate a ratio of the total amount Vt to the total amount Vt0; and transmit, through the first communication interface, the total amount information as being said ratio.

3. The liquid consuming device according to claim 2, wherein the first controller is configured to:

determine whether the calculated ratio exceeds 1; and in a case it is determined that the calculated ratio exceeds 1, transmit, through the first communication interface, the total amount information of 1.

4. The liquid consuming device according to claim 1, wherein the first controller is configured to:

determine the total amount Vt at every predetermined time interval; and based on determining the total amount Vt at the every predetermined time interval, transmit, through the first communication interface, the total amount information indicating the total amount Vt determined at the every predetermined time interval.

5. The liquid consuming device according to claim 1, wherein the first controller is configured to, in response to that it is determined that the signal is received from the liquid level sensor and the measured elapsed time is shorter than the first time, transmit, through the first communication interface, the liquid level information.

6. The liquid consuming device according to claim 1, wherein the first controller is configured to, in a case it is determined that the measured elapsed time is equal to or longer than the first time, transmit, through the first communication interface, the liquid level information at the same time as the time of transmitting the total amount information.

7. The liquid consuming device according to claim 1, wherein the first liquid chamber of the cartridge installed in the installation case communicates with the outside, wherein the second liquid chamber of the tank communicates with the outside, wherein a part of the second liquid chamber is located below the first liquid chamber of the cartridge installed in the installation case, and wherein the predetermined position is located below the first liquid chamber of the cartridge installed in the installation case.

8. The liquid consuming device according to claim 1, wherein the first controller is configured to:

receive a discharge instruction to discharge a liquid through the head;

count a discharge amount of the liquid that is discharged from the head according to the received discharge instruction; and determine the total amount Vt of the first liquid amount and the second liquid amount after a liquid is discharged from the head according to the discharge instruction based on a counted value corresponding to the counted discharge amount of the liquid.

9. The liquid consuming device according to claim 1, wherein the first controller is configured to:

determine a liquid amount Vc and a liquid amount Vs, the liquid amount Vc being liquid amount in the first liquid chamber that is installed in the installation case and communicates with the second liquid chamber through the flow path, the liquid amount Vs being liquid amount in the second liquid chamber that communicates with the first liquid chamber of the cartridge installed in the installation case through the flow path from the determined total amount Vt; and transmit, through the first communication interface, the total amount information, cartridge information indicating the determined liquid amount Vc, and tank information indicating the determined liquid amount Vs.

10. The liquid consuming device according to claim 1, comprising the cartridge.

11. A liquid consuming system comprising:

the liquid consuming device according to claim 1; and the external device comprising a second communication interface, a third communication interface, and a second controller configured to:

receive the total amount information through the second communication interface connected to the first communication interface;

determine a date/time when there is no liquid amount in the first liquid chamber of the cartridge installed in the installation case from the total amount Vt indicated by the received total amount information;

determine a predetermined date/time, the predetermined date/time being prior to the determined date/time by a predetermined time; and in a case the determined predetermined date/time is reached, transmit, through the third communication interface, order information indicating to order the cartridge.

12. A liquid consuming system comprising:

the liquid consuming device according to claim 11; and an external device comprising a second communication interface, a third communication interface, and a second controller configured to:

receive the cartridge information and the tank information through the second communication interface that is connected to the first communication interface;

from the liquid amount Vc indicated by the received cartridge information, determine a first date/time when there is no liquid in the first liquid chamber of the cartridge installed in the installation case;

from the liquid amount Vc indicated by the received tank information, determine a second date/time when there is no liquid in the second liquid chamber of the tank;

determine a predetermined date/time, the predetermined data/time being prior to an intermediate date/time by a predetermined time, the intermediate date/time being between the determined first date/time and the determined second date/time; and in a case the determined predetermined date/time is reached, transmit, through the third communication interface, order information indicating to order the cartridge.

13. A liquid consuming device comprising:

an installation case configured to receive a cartridge, the cartridge comprising a first liquid chamber storing a liquid;

a tank comprising a second liquid chamber;

a flow path configured to communicate with the second liquid chamber and the first liquid chamber of the cartridge installed in the installation case;

a head communicated with the second liquid chamber;

a first communication interface that is an external connection interface;

a liquid level sensor; and a first controller configured to:

determine a liquid amount Vc and a liquid amount Vs, the liquid amount Vc being liquid amount in the first liquid chamber that is installed in the installation case to communicate with the second liquid chamber through the flow path, the liquid amount Vs being liquid amount in the second liquid chamber that communicates with the first liquid chamber of the cartridge installed in the installation case through the flow path;

transmit, through the first communication interface that is connected to an external device, cartridge information, the cartridge information indicating the determined liquid amount Vc and tank information indicating the determined liquid amount Vs;

receive, from the liquid level sensor, a signal in a case the position of a liquid level in the second liquid chamber of the tank is lower than a predetermined position;

measure an elapsed time when the signal is received from a predetermined time point;

determine whether the measured elapsed time is shorter than a first time; and transmit, through the first communication interface, liquid level information, the liquid level information corresponding to the received signal, wherein, in a case it is determined that the measured elapsed time is shorter than the first time, the liquid level information is transmitted through the first communication interface at a different time from the time of transmitting the cartridge information and the tank information.

14. The liquid consuming device according to claim 13, wherein the first controller is configured to:

determine a liquid amount Vc0 and a liquid amount Vs0, the liquid amount Vc0 being liquid amount in the first liquid chamber in a state where a liquid does not move in the second liquid chamber and the first liquid chamber, the liquid amount Vs0 being liquid amount in the second liquid chamber in a state where a liquid does not flow in from the first liquid chamber to the second liquid chamber;

calculate a cartridge ratio of the liquid amount Vc to the liquid amount Vc0;

calculate a tank ratio of the liquid amount Vs to the liquid amount Vs0; and transmit, through the first communication interface, the cartridge information as being the cartridge ratio and the tank information as being the tank ratio.

15. The liquid consuming device according to claim 14, wherein the first controller is configured to:

determine whether the calculated cartridge ratio exceeds 1; and in a case it is determined that the calculated cartridge ratio exceeds 1, transmit, through the first communication interface, the cartridge information of 1.

16. The liquid consuming device according to claim 14, wherein the first controller is configured to:

determine whether the calculated tank ratio exceeds 1; and in a case it is determined that the calculated tank ratio exceed 1, transmit, through the first communication interface, the tank information of 1.

17. The liquid consuming device according to claim 13, wherein the first controller is configured to:

determine the liquid amount Vc and the liquid amount Vs at every predetermined time interval; and based on determining the liquid amount Vc and the liquid amount Vs at the every predetermined time interval, transmit, through the first communication interface, the cartridge information indicating the determined liquid amount Vc and the tank information indicating the determined liquid amount Vs at the every predetermined time interval.

18. The liquid consuming device according to claim 13, wherein the first controller is configured to, in response to that it is determined that the signal is received from the liquid level sensor and the measured elapsed time is shorter than the first time, transmit, through the first communication interface, the cartridge information and the tank information.

19. The liquid consuming device according to claim 13, wherein the first controller is configured to, in a case it is determined that the measured elapsed time is equal to or longer than the first time, transmit, through the first communication interface, the liquid level information at the same time as the time of transmitting the cartridge information and the tank information.

20. The liquid consuming device according to claim 13, wherein the first liquid chamber of the cartridge installed in the installation case communicates with the outside, wherein the second liquid chamber of the tank communicates with the outside, wherein a part of the second liquid chamber is located below the first liquid chamber of the cartridge installed in the installation case, and wherein the predetermined position is located below the first liquid chamber of the cartridge installed in the installation case.

21. The liquid consuming device according to claim 13, wherein the first controller is configured to:

receive a discharge instruction to discharge a liquid through the head;

count a discharge amount of the liquid that is discharged from the head according to the received discharge instruction; and based on a counted value corresponding to the counted discharge amount of the liquid, determine a liquid amount Vc in the first liquid chamber and a liquid amount Vs in the second liquid chamber after a liquid is discharged from the head according to the discharge instruction.

22. The liquid consuming device according to claim 13, wherein the first controller is configured to:

determine a total amount Vt, the total amount Vt corresponding to a sum of the determined liquid amount Vc and the determined liquid amount Vs, and transmit, through the first communication interface, the cartridge information, the tank information, and total amount information indicating the determined total amount Vt.

23. The liquid consuming device according to claim 13, comprising the cartridge.

* * * * *